US011387064B2

(12) United States Patent
Yamazaki et al.

(10) Patent No.: US 11,387,064 B2
(45) Date of Patent: Jul. 12, 2022

(54) MEMS ELEMENT FUSE-LIKE ELECTRICAL CIRCUIT INTERRUPTER

(71) Applicant: KABUSHIKI KAISHA TOSHIBA, Tokyo (JP)

(72) Inventors: Hiroaki Yamazaki, Yokohama Kanagawa (JP); Kei Masunishi, Kawasaki Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 140 days.

(21) Appl. No.: 17/017,253

(22) Filed: Sep. 10, 2020

(65) Prior Publication Data

US 2021/0175035 A1 Jun. 10, 2021

(30) Foreign Application Priority Data

Dec. 9, 2019 (JP) ..... JP2019-222325

(51) Int. Cl.
*H01H 59/00* (2006.01)
*H01H 1/00* (2006.01)

(52) U.S. Cl.
CPC ..... *H01H 59/0009* (2013.01); *H01H 1/0036* (2013.01)

(58) Field of Classification Search
CPC ..... H01H 59/0009–1/0036
See application file for complete search history.

(56) References Cited

U.S. PATENT DOCUMENTS 8,520,279 B2 * 8/2013 Kouma ..... H02N 1/006 356/900
8,564,928 B2 * 10/2013 Ikehashi ..... H01G 5/16 361/290
2011/0108933 A1 * 5/2011 Nakatani ..... H04R 19/04 257/E29.324
2020/0076394 A1 3/2020 Ikehashi et al.
2022/0084767 A1 * 3/2022 Yamazaki ..... H01H 1/0036

FOREIGN PATENT DOCUMENTS

JP S59-121730 A 7/1984
JP 2020-35828 A 3/2020

* cited by examiner

*Primary Examiner* — Vanessa Girardi
(74) *Attorney, Agent, or Firm* — Finnegan, Henderson, Farabow, Garrett & Dunner L.L.P.

(57) ABSTRACT

According to one embodiment, a MEMS element includes a first member, and an element part. The element part includes a first fixed electrode fixed to the first member, a first movable electrode facing the first fixed electrode, a first conductive member electrically connected to the first movable electrode, and a second conductive member electrically connected to the first movable electrode. The first conductive member and the second conductive member support the first movable electrode to be separated from the first fixed electrode in a first state before a first electrical signal is applied between the second conductive member and the first fixed electrode. The first conductive member and the second conductive member are in a broken state in a second state after the first electrical signal is applied between the second conductive member and the first fixed electrode.

20 Claims, 21 Drawing Sheets

MEMS ELEMENT FUSE-LIKE ELECTRICAL CIRCUIT INTERRUPTER

CROSS-REFERENCE TO RELATED APPLICATIONS

This application is based upon and claims the benefit of priority from Japanese Patent Application No. 2019-222325, filed on Dec. 9, 2019; the entire contents of which are incorporated herein by reference.

FIELD

Embodiments of the invention generally relate to a MEMS element and an electrical circuit.

BACKGROUND

For example, a MEMS (Micro Electro Mechanical Systems) element is used in a switch or the like. A stable operation of the MEMS element is desirable.

DETAILED DESCRIPTION

Figure 1A:
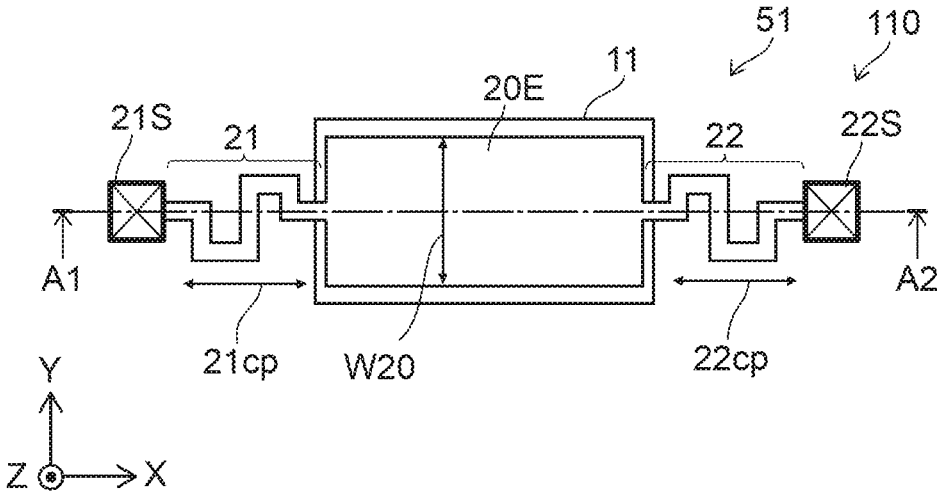
FIG. 1A and FIG. 1B are schematic views illustrating a MEMS element according to a first embodiment.

According to one embodiment, a MEMS element includes a first member, and an element part. The element part includes a first fixed electrode fixed to the first member, a first movable electrode facing the first fixed electrode, a first conductive member electrically connected to the first movable electrode, and a second conductive member electrically connected to the first movable electrode. The first conductive member and the second conductive member support the first movable electrode to be separated from the first fixed electrode in a first state before a first electrical signal is applied between the second conductive member and the first fixed electrode. The first conductive member and the second conductive member are in a broken state in a second state after the first electrical signal is applied between the second conductive member and the first fixed electrode.

According to one embodiment, an electrical circuit includes the MEMS element described above, and an electrical element electrically connected to the MEMS element. The electrical element includes at least one selected from the group consisting of a resistance, a capacitance element, an inductor element, a diode, and a transistor.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

Figure 1B:
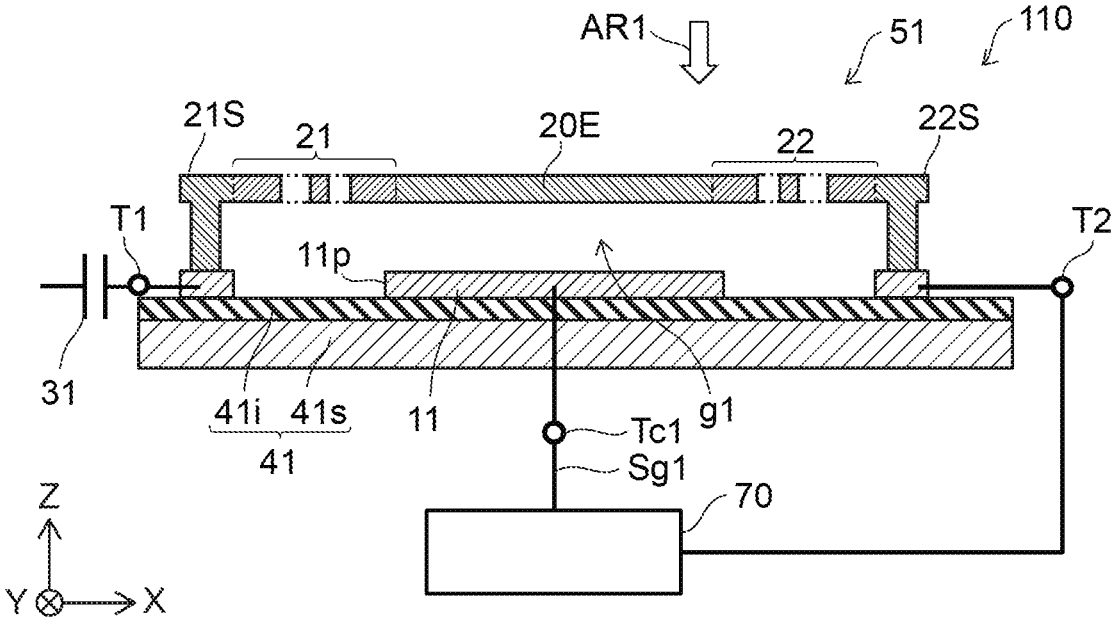

FIG. 1A and FIG. 1B are schematic views illustrating a MEMS element according to a first embodiment.

FIG. 1A is a plan view as viewed along arrow AR1 of FIG. 1B. FIG. 1B is a line A1-A2 cross-sectional view of FIG. 1A.

As shown in FIG. 1B, the MEMS element 110 according to the embodiment includes a first member 41 and an element part 51. A first member 41 is, for example, a base body. In the example, the first member 41 includes a substrate 41*s* and an insulating layer 41*i*. The substrate 415 is, for example, a silicon substrate. The substrate 41*s* may include a control element such as a transistor, etc. The insulating layer 41*i* is provided on the substrate 415. For example, the element part 51 is provided on the insulating layer 41*i*. In the embodiment, the first member 41 may include interconnects, etc. (not illustrated). For example, the interconnects electrically connect the element part 51 and the substrate 41*s*. The interconnects may include contact vias.

As shown in FIG. 1A and FIG. 1B, the element part 51 includes a first fixed electrode 11, a first movable electrode 20E, a first conductive member 21, and a second conductive member 22. The first fixed electrode 11 is fixed to the first member 41. For example, the first fixed electrode 11 is provided on the insulating layer 41*i*.

The first movable electrode 20E faces the first fixed electrode 11. The first conductive member 21 is electrically connected to the first movable electrode 20E. The second conductive member 22 is electrically connected to the first movable electrode 20E.

As described below, for example, a first electrical signal Sg1 (referring to FIG. 1B) can be applied between the second conductive member 22 and the first fixed electrode 11. The state before the first electrical signal Sg1 is applied is taken to be a first state (e.g., an initial state). FIG. 1A and FIG. 1B illustrate the first state.

As shown in FIG. 1B, the first conductive member 21 and the second conductive member 22 support the first movable electrode 20E to be separated from the first fixed electrode 11 in the first state. For example, a first gap g1 is between the first fixed electrode 11 and the first movable electrode 20E in the first state.

For example, a first supporter 21S and a second supporter 22S are provided. The first supporter 21S and the second supporter 22S are fixed to the first member 41. The first supporter 21S and the second supporter 22S are conductive.

One end of the first conductive member 21 is connected to the first supporter 21S. The first conductive member 21 is supported by the first supporter 21S. The other end of the first conductive member 21 is connected to the first movable electrode 20E. One end of the second conductive member 22 is connected to the second supporter 22S. The second conductive member 22 is supported by the second supporter 22S. The other end of the second conductive member 22 is connected to the first movable electrode 20E. In the example, the first movable electrode 20E is between the first supporter 21S and the second supporter 22S. The first conductive member 21 is between the first supporter 21S and the first movable electrode 20E. In the example, the second conductive member 22 is between the first movable electrode 20E and the second supporter 22S.

As shown in FIG. 1A, for example, the first conductive member 21 and the second conductive member 22 are fine wire-shaped. In the example, the first conductive member 21 and the second conductive member 22 have meandering structures. For example, the first conductive member 21 and the second conductive member 22 are spring members.

As shown in FIG. 1A, for example, the widths of the first and second conductive members 21 and 22 are less than a width W20 of the first movable electrode 20E. The first conductive member 21 and the second conductive member 22 deform more easily than the first movable electrode 20E.

The direction from the first fixed electrode 11 toward the first movable electrode 20E is taken as a Z-axis direction. One direction perpendicular to the Z-axis direction is taken as an X-axis direction. A direction perpendicular to the Z-axis direction and the X-axis direction is taken as a Y-axis direction.

In the example, the direction from the first conductive member 21 toward the second conductive member 22 is along the X-axis direction. The distance (the length in the Z-axis direction) between the first fixed electrode 11 and the first movable electrode 20E is changeable according to the potential difference between the first fixed electrode 11 and the first movable electrode 20E. The first movable electrode 20E is displaceable when referenced to the first fixed electrode 11.

A first terminal T1 and a second terminal T2 may be provided as shown in FIG. 1B. The first terminal T1 is electrically connected to the first conductive member 21. The second terminal T2 is electrically connected to the second conductive member 22. For example, a current can flow between the first terminal T1 and the second terminal T2 in the first state. At this time, the MEMS element 110 is in a conducting state (e.g., an on-state). As described below, the first conductive member 21 and the second conductive member 22 can be broken. In such a case, a current does not flow between the first terminal T1 and the second terminal T2. At this time, the MEMS element 110 is in a nonconducting state (e.g., an off-state).

In the on-state, for example, a current can flow in a first current path 21*cp* including the first conductive member 21 and the first movable electrode 20E (referring to FIG. 1A). In the on-state, for example, a current can flow in a second current path 22*cp* including the second conductive member 22 and the first movable electrode 20E (referring to FIG. 1A).

The MEMS element 110 can function as a normally-on switch element.

The element part 51 may include a first capacitance element 31. For example, the first capacitance element 31 is electrically connected to the first conductive member 21. In the example, the first capacitance element 31 is electrically connected to the first terminal T1. The electrical connection to the first capacitance element 31 can be controlled by controlling the on-state or the off-state of the element part 51.

As shown in FIG. 1B, for example, a controller 70 may be provided. For example, the controller 70 is electrically connected to a first control terminal Tc1 and the second terminal T2. The first control terminal Tc1 is electrically connected to the first fixed electrode 11. The first electrical signal Sg1 can be applied between the second conductive member 22 and the first fixed electrode 11 by the controller 70. The first electrical signal Sg1 includes at least one of a voltage signal or a current signal.

For example, the potential of the second conductive member 22 (e.g., the potential of the second terminal T2) is fixed, and the potential of the first fixed electrode 11 is controllable by the controller 70. In the embodiment, the potential of the first fixed electrode 11 may be substantially fixed, and the potential of the second conductive member 22 may be controllable by the controller 70. Hereinbelow, one example will be described in which the potential of the second conductive member 22 (e.g., the potential of the second terminal T2) is fixed. In such a case, the potential of the first fixed electrode 11 is controlled by the controller 70. The polarity of the potential difference between the second conductive member 22 and the first fixed electrode 11 is arbitrary.

In the first state, the potential of the first movable electrode 20E is substantially equal to the potential of the second conductive member 22. The potential difference between the first fixed electrode 11 and the first movable electrode 20E is changed by changing the potential of the first fixed electrode 11. For example, the distance between the first movable electrode 20E and the first fixed electrode 11 decreases as the potential difference increases. For example, this is based on an electrostatic force. When the potential difference becomes large, the first movable electrode 20E contacts the first fixed electrode 11, and a current can flow in the conductive member via the first movable electrode 20E and the first fixed electrode 11. The conductive member can be broken thereby. The first state before breaking and the second state after breaking can be formed thereby. The phenomenon of the first movable electrode 20E and the first fixed electrode 11 contacting is called "pull-in" or "pull-down". The voltage that generates "pull-in" or "pull-down" is called the "pull-in voltage" or the "pull-down voltage".

For example, the element part 51 of the MEMS element 110 can function as a OTP (One Time Programmable) element.

For example, the rigidity of the first conductive member 21 may be different from the rigidity of the second conductive member 22. For example, the rigidity of the first conductive member 21 may be less than the rigidity of the second conductive member 22. For example, the first conductive member 21 and the second conductive member 22 are mutually-asymmetric. For example, by such a configuration, the first movable electrode 20E easily changes to a tilted state when the first movable electrode 20E approaches the first fixed electrode 11. The first movable electrode 20E may approach the first fixed electrode 11 in a tilted state.

An example of a transition from the first state to the second state will now be described.

FIG. 2A to FIG. 2C, FIG. 3A and FIG. 3B are schematic cross-sectional views illustrating the MEMS element according to the first embodiment.

These drawings illustrate the change of the element part 51 when the first electrical signal Sg1 is applied between the second conductive member 22 and the first fixed electrode 11. As described above, the first electrical signal Sg1 is supplied by the controller 70.

Figure 2A:
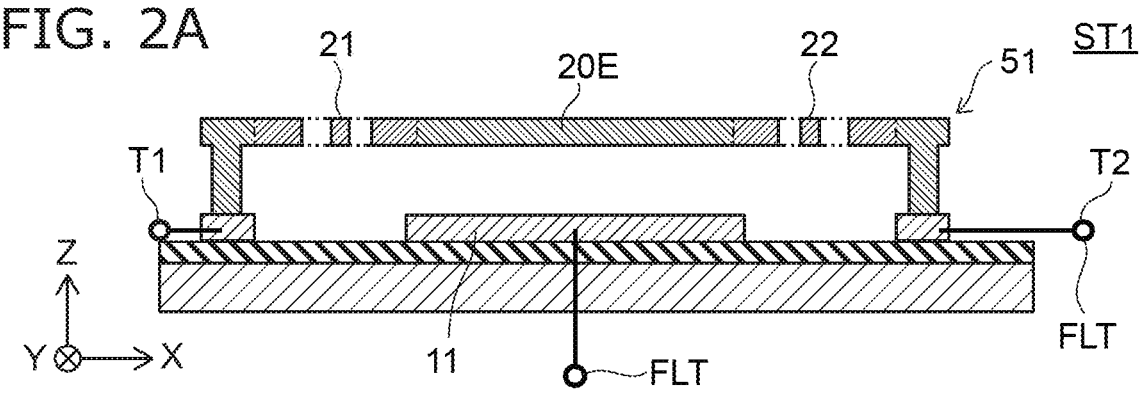
FIG. 2A to FIG. 2C are schematic cross-sectional views illustrating the MEMS element according to the first embodiment.

In the first state ST1 shown in FIG. 2A, the first electrical signal Sg1 is not applied between the second conductive member 22 and the first fixed electrode 11. For example, the second conductive member 22 and the first fixed electrode 11 are in a floating state FLT. At this time, the first movable electrode 20E is separated from the first fixed electrode 11. In such a first state ST1, a current can flow between the first terminal T1 and the second terminal T2. The element part 51 is in the conducting state (the on-state) in the first state ST1. In the first state ST1, the potential difference between the second conductive member 22 and the first fixed electrode 11 may be less than the pull-in voltage.

Figure 2B:
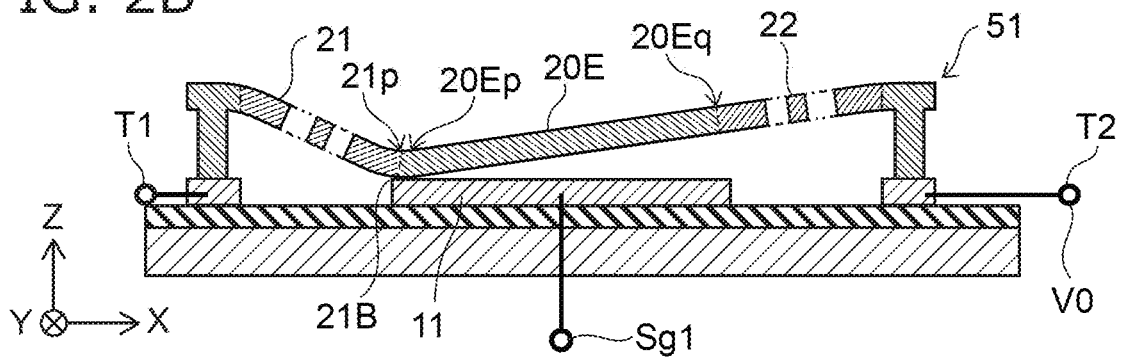

As shown in FIG. 2B, for example, the second terminal T2 (the second conductive member 22) is set to a ground potential V0, and the first electrical signal Sg1 is applied to the first fixed electrode 11. Thereby, the first movable electrode 20E is caused to approach the first fixed electrode 11. For example, the first movable electrode 20E tilts easily when the first conductive member 21 and the second conductive member 22 are asymmetric. For example, compared to an end portion 20Eq at the second conductive member 22 side of the first movable electrode 20E, an end portion 20Ep at the first conductive member 21 side of the first movable electrode 20E approaches the first fixed electrode 11. An electric field concentrates at the end portion 20Ep at the first conductive member 21 side of the first movable electrode 20E and an end portion 21*p* at the first movable electrode 20E side of the first conductive member 21. For example, the end portion 21*p* contacts the first fixed electrode 11. For example, the end portion 20Ep contacts the first fixed electrode 11. Thereby, the temperature easily rises locally at the end portions 20Ep and 21*p*. For example, the rise of the temperature is due to Joule heat.

The first conductive member 21 breaks when the temperature of at least one of the end portion 20Ep or the end portion 21*p* rises locally. As shown in FIG. 2B, a break portion 21B occurs in the first conductive member 21. The first conductive member 21 is divided at the break portion 21B.

For example, as shown in FIG. 1A, a portion of the first conductive member 21 may overlap the first fixed electrode 11 in the Z-axis direction. For example, when a portion of the first conductive member 21 overlaps the first fixed electrode 11 in the Z-axis direction, the portion (the end portion 21*p*) of the first conductive member 21 easily contacts the first fixed electrode 11 when the first movable electrode 20E approaches the first fixed electrode 11. For example, a current locally flows between the first fixed electrode 11 and the portion (the end portion 21*p*) of the first conductive member 21. The first conductive member 21 is broken more stably by the current concentrating at the portion (the end portion 21*p*) of the first conductive member 21. For example, the mechanical rigidity of the first conductive member 21 is less than the mechanical rigidity of the first movable electrode 20E. Thereby, the end portion 21*p* easily contacts the first fixed electrode 11.

Figure 2C:
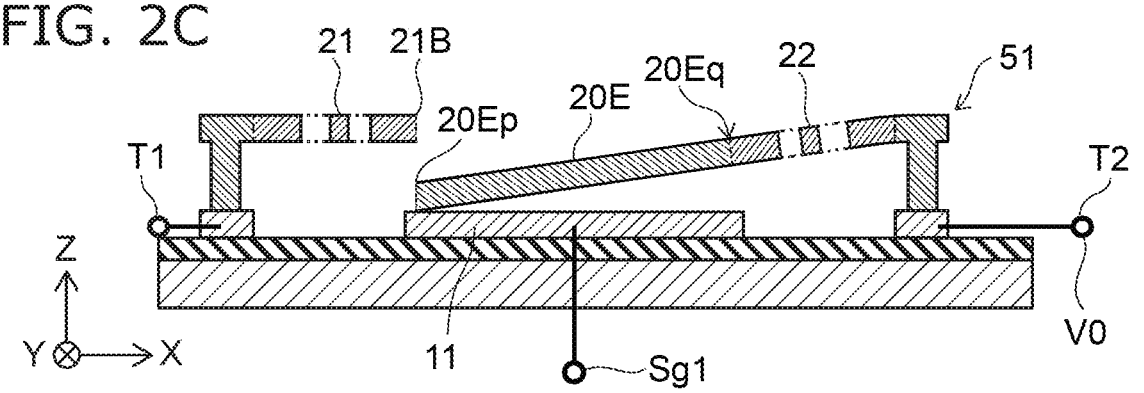

As shown in FIG. 2C, the broken first conductive member 21 may approach the state of FIG. 2A. For example, this is due to the restoring force due to the elasticity of the first conductive member 21. As shown in FIG. 2C, the end portion 20Ep of the first movable electrode 20E is separated from the first conductive member 21.

Figure 3A:
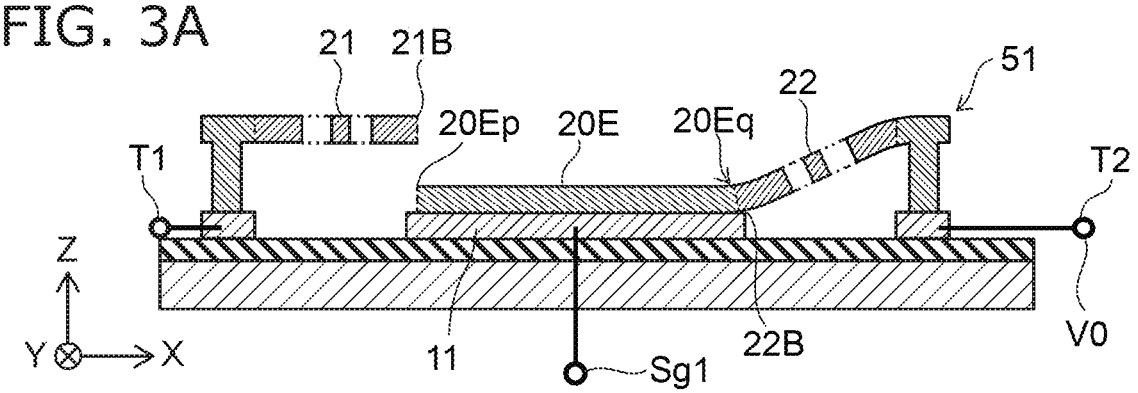
FIG. 3A and FIG. 3B are schematic cross-sectional views illustrating the MEMS element according to the first embodiment.

As shown in FIG. 3A, substantially the entire first movable electrode 20E may contact the first fixed electrode 11 when the application of the first electrical signal Sg1 is continued. This state is, for example, the pull-down state. When the first movable electrode 20E contacts the first fixed electrode 11, there are cases where the first movable electrode 20E is adhered to the first fixed electrode 11, and the first movable electrode 20E substantially does not separate from the first fixed electrode 11.

As shown in FIG. 3A, when the application of the first electrical signal Sg1 is continued, the temperature of the second conductive member 22 rises, and the second conductive member 22 breaks. For example, the rise of the temperature is due to Joule heat. A break portion 22B occurs. The second conductive member 22 is divided at the break portion 22B. For example, the break portion 22B is formed at the vicinity of the end portion of the second conductive member 22 at the first movable electrode 20E side. The application of the first electrical signal Sg1 ends.

Figure 3B:
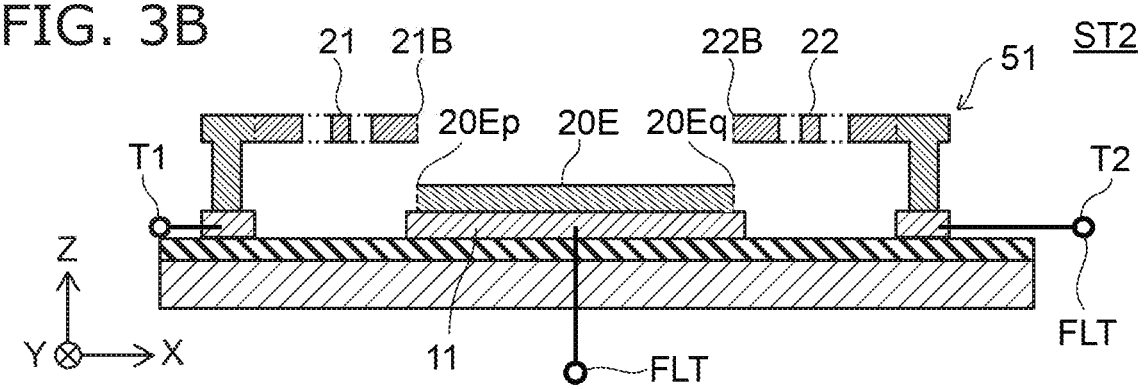

Subsequently, as shown in FIG. 3B, the broken second conductive member 22 may approach the state of FIG. 2A. For example, this is due to the restoring force due to the elasticity of the second conductive member 22. As shown in FIG. 3B, the end portion 20Eq of the first movable electrode 20E is separated from the second conductive member 22.

A second state ST2 shown in FIG. 3B is a state after the first electrical signal Sg1 is applied between the second conductive member 22 and the first fixed electrode 11. For example, in the second state ST2, the first fixed electrode 11 is in, for example, the floating state FLT. The broken states of the first and second conductive members 21 and 22 continue even after the application of the first electrical signal Sg1 has ended. A current does not flow between the first terminal T1 and the second terminal T2 in the second state ST2. The element part 51 is in the nonconducting state (the off-state) in the second state ST2. For example, in the second state ST2, the second conductive member 22 is in, for example, the floating state FLT. Or, in the second state ST2, the potential of the second conductive member 22 may have the potential of a circuit connected to the second conductive member 22.

Thus, in the embodiment, both the first conductive member 21 and the second conductive member 22 are in a broken state in the second state ST2 after the first electrical signal Sg1 is applied between the second conductive member 22 and the first fixed electrode 11. For, example, the first conductive member 21 is in a first broken state in the second broken state in the second state ST2 and the second conductive member 22 is in the second broken state in the second state ST2. The current that flows between the first terminal T1 and the second terminal T2 can be stably blocked thereby.

A reference example may be considered in which one of the first conductive member 21 or the second conductive member 22 is broken. For example, in a first reference example, the second conductive member 22 side of the first movable electrode 20E contacts the first fixed electrode 11 when the first electrical signal Sg1 is applied to the first fixed electrode 11. In such a case, the second conductive member 22 is broken by the Joule heat due to the current of the first electrical signal Sg1. On the other hand, the other end (the first terminal T1) of the first conductive member 21 is floating. Therefore, when the first electrical signal Sg1 is applied to the first fixed electrode 11, a current does not flow in the first conductive member 21, and the first conductive member 21 is not broken. In such a first reference example as well, the current that flows between the first terminal T1 and the second terminal T2 can be blocked.

In the first reference example after the second conductive member 22 is broken, the first terminal T1 is electrically connected to the first fixed electrode 11 via the first conductive member 21 and the first movable electrode 20E. For example, when a transistor that controls the application of the first electrical signal Sg1 to the first fixed electrode 11 or the like is connected to the first fixed electrode 11, the parasitic capacitance of the transistor remains even after the application of the first electrical signal Sg1 is ended. The parasitic capacitance of the transistor affects the capacitance of the first terminal T1. In the first reference example, such an unnecessary capacitance remains in the element part 51. The remaining capacitance easily causes unstable electrical characteristics of the off-state of the element part 51 functioning as a switch. For example, when the signal of the circuit in which the element part 51 is embedded has a high frequency, the remaining capacitance makes the characteristics of the element part 51 unstable.

In the embodiment, the first conductive member 21 and the second conductive member 22 are in a broken state in the second state ST2. Therefore, the first terminal T1 is separated from the first fixed electrode 11 and the parasitic capacitance of the transistor. The electrical characteristics of the element part 51 in the off-state are stabilized thereby. Stable characteristics can be maintained even for high frequency switching. According to the embodiment, a MEMS element can be provided in which a stable operation is possible.

In the embodiment, for example, the first conductive member 21 breaks when the first electrical signal Sg1 is applied between the second conductive member 22 and the first fixed electrode 11. Continuing, the second conductive member 22 also is broken by continuing the application of the first electrical signal Sg1. Or, the application of the first electrical signal Sg1 can be ended after the first conductive member 21 has broken and before the second conductive member 22 has broken. However, the first electrical signal Sg1 may not be ended partway because the second conductive member 22 can be broken by continuing the application of the first electrical signal Sg1.

In the description recited above, the first electrical signal Sg1 is applied between the second conductive member 22 and the first fixed electrode 11. In the embodiment, the first electrical signal Sg1 may be applied between the first conductive member 21 and the first fixed electrode 11. In such a case, the first movable electrode 20E is caused to tilt so that the distance between the first fixed electrode 11 and the end portion at the second conductive member 22 side of the first movable electrode 20E is less than the distance between the first fixed electrode 11 and the end portion at the first conductive member 21 side of the first movable electrode 20E. Because the first movable electrode 20E approaches the first fixed electrode 11 in the tilted state, both the first conductive member 21 and the second conductive member 22 are in a broken state in the second state ST2 after the first electrical signal Sg1 is applied.

As recited above, both of two conductive members can easily be broken by the first movable electrode 20E approaching the first fixed electrode 11 in the tilted state. For example, when one of the first conductive member 21 or the second conductive member 22 will become proximate to the first fixed electrode 11, the first electrical signal Sg1 is applied between the first fixed electrode 11 and the other of the first conductive member 21 or the second conductive member 22. The conductive member to which the first electrical signal Sg1 is applied may be selected to match the tilt direction.

In the embodiment, for example, the first movable electrode 20E is tilted more easily by setting the mechanical rigidities of the two conductive members to be asymmetric. For example, the distance between the first movable electrode 20E and the first fixed electrode 11 in the first state ST1 may be different between the first conductive member 21 side and the second conductive member 22 side. Thereby, it is easier for the first movable electrode 20E to approach the first fixed electrode 11 in a state in which the distance between the first movable electrode 20E and the first fixed electrode 11 is nonuniform. For example, a protrusion or the like may be provided in the lower surface of the end portion 20Ep of the first movable electrode 20E or the upper surface of an end portion 11*p* of the first fixed electrode 11. Even in such a case, the first conductive member 21 and the second conductive member 22 break more easily in the second state ST2. For example, the surface area of the portion at which the first movable electrode 20E and the first fixed electrode 11 face each other may be different between the first conductive member 21 side and the second conductive member 22 side.

As shown in FIG. 1B, for example, the direction from the first fixed electrode 11 toward the first movable electrode 20E is taken as a first direction. The first direction corresponds to the Z-axis direction. At least one of a portion of the first conductive member 21 or a portion of the second conductive member 22 may overlap the first fixed electrode 11 in the first direction. When a portion of the first conductive member 21 overlaps the first fixed electrode 11, a large current flows locally between the portion (e.g., the end portion 21*p* illustrated in FIG. 2B) of the first conductive member 21 and the end portion 11*p* of the first fixed electrode 11 (referring to FIG. 1B). The first conductive member 21 is broken more easily thereby. On the other hand, when a portion of the second conductive member 22 overlaps the first fixed electrode 11, a large current flows locally between the end portion of the portion of the second conductive member 22 and the end portion 11*p* of the first fixed electrode 11. The second conductive member 22 is broken more easily thereby.

In the embodiment as described above, for example, a current can flow between the first movable electrode 20E and the first fixed electrode 11 when the first electrical signal Sg1 is applied between the second conductive member 22 and the first fixed electrode 11. For example, the first movable electrode 20E contacts the first fixed electrode 11 when the first electrical signal Sg1 is applied between the second conductive member 22 and the first fixed electrode 11.

Several examples of configurations in which the first conductive member 21 and the second conductive member 22 break more easily will now be described.

Figure 4A:
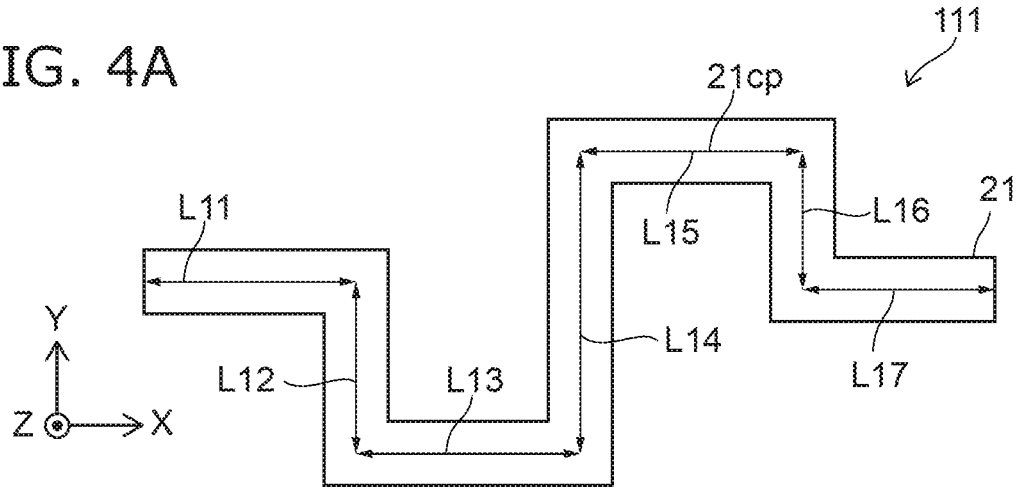
FIG. 4A and FIG. 4B are schematic plan views illustrating a MEMS element according to the first embodiment.
Figure 4B:
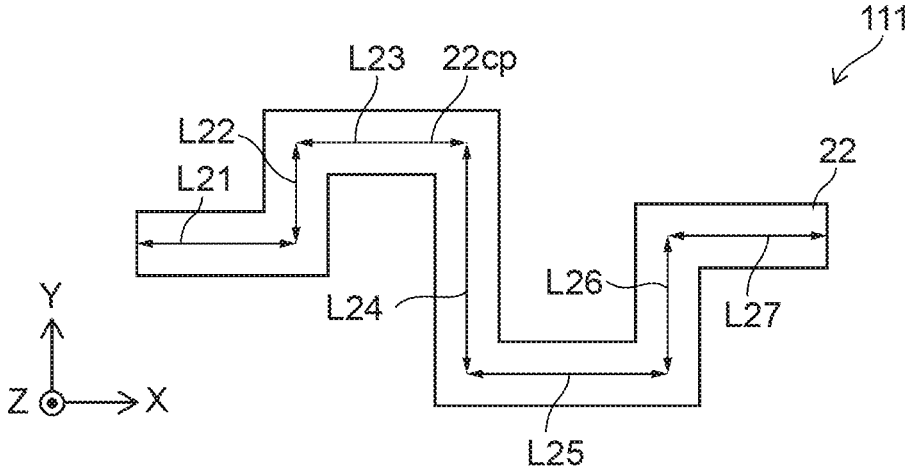

FIG. 4A and FIG. 4B are schematic plan views illustrating a MEMS element according to the first embodiment.

These drawings illustrate a portion of the MEMS element 111 according to the embodiment. FIG. 4A illustrates the first conductive member 21. FIG. 4B illustrates the second conductive member 22.

As shown in FIG. 4A, the first conductive member 21 has a first length along the first current path 21*cp* including the first conductive member 21 and the first movable electrode 20E. The first length corresponds to the sum of lengths L11 to L17.

As shown in FIG. 4B, the second conductive member 22 has a second length along the second current path 22*cp* including the second conductive member 22 and the first movable electrode 20E. The second length corresponds to the sum of lengths L21 to L27.

In the example, the second length is less than the first length. In such a case, the rigidity of the first conductive member 21 is less than the rigidity of the second conductive member 22. The characteristics of the first conductive member 21 and the characteristics of the second conductive member 22 are made asymmetric thereby.

Figure 5A:
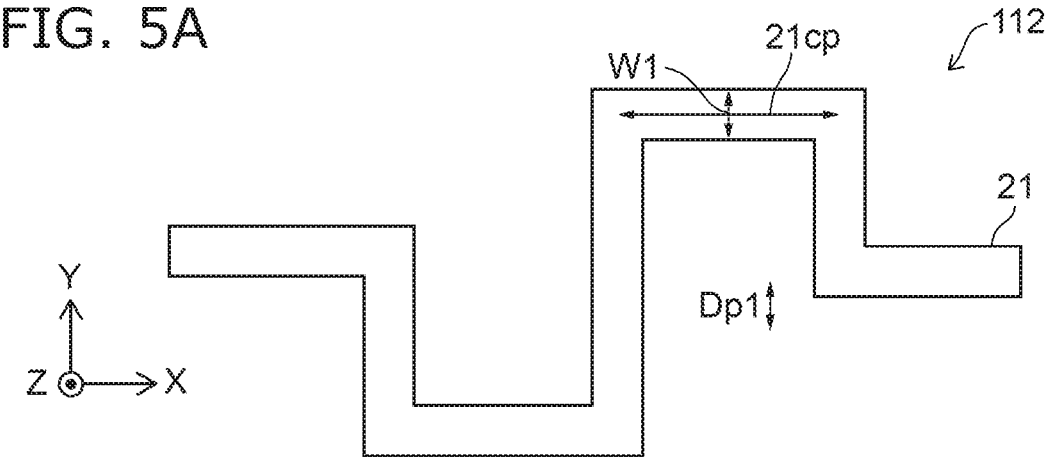
FIG. 5A and FIG. 5B are schematic plan views illustrating a MEMS element according to the first embodiment.
Figure 5B:
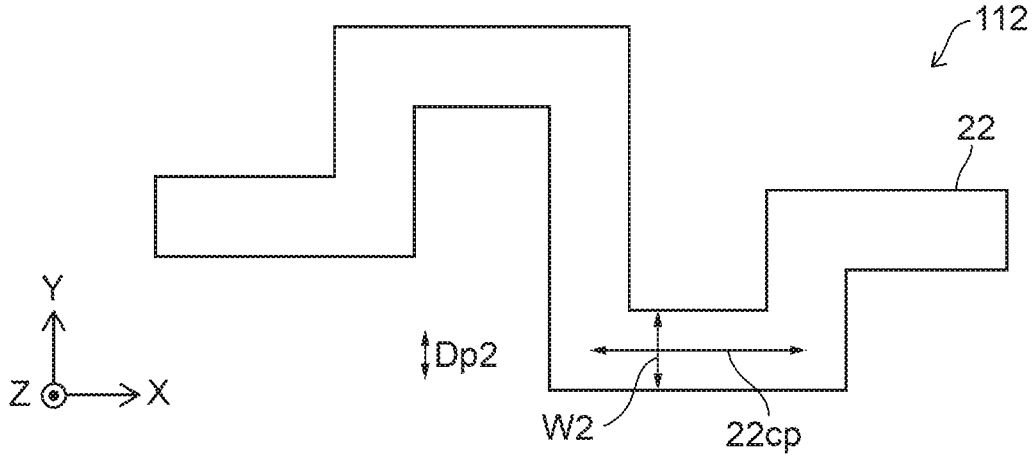

FIG. 5A and FIG. 5B are schematic plan views illustrating a MEMS element according to the first embodiment.

These drawings illustrate a portion of the MEMS element 112 according to the embodiment. FIG. 5A illustrates the first conductive member 21. FIG. 5B illustrates the second conductive member 22.

As shown in FIG. 5A, the first conductive member 21 has a first width W1. The first width W1 is the length of the first conductive member 21 in a direction Dp1 perpendicular to the first current path 21*cp* including the first conductive member 21 and the first movable electrode 20E. The first width W1 may be the thickness (the length along the Z-axis direction).

As shown in FIG. 5B, the second conductive member 22 has a second width W2. The second width W2 is the length of the second conductive member 22 in a direction Dp2 perpendicular to the second current path 22*cp* including the second conductive member 22 and the first movable electrode 20E. The second width W2 may be the thickness (the length along the Z-axis direction).

In the example, the second width W2 is greater than the first width W1. In such a case, the rigidity of the first conductive member 21 is less than the rigidity of the second conductive member 22. Thereby, the characteristics of the first conductive member 21 are asymmetric with the characteristics of the second conductive member 22.

Thus, the second conductive member 22 may have at least one of the second length that is less than the first length, or the second width W2 that is greater than the first width W1. For example, the rigidity of the first conductive member 21 is less than the rigidity of the second conductive member 22. The characteristics of the first conductive member 21 are asymmetric with the characteristics of the second conductive member 22.

In the embodiment, the melting point of at least a portion of the first conductive member 21 may be different from the melting point of at least a portion of the second conductive member 22. In the embodiment, the electrical resistance of the first conductive member 21 may be different from the electrical resistance of the second conductive member 22.

Figure 6A:
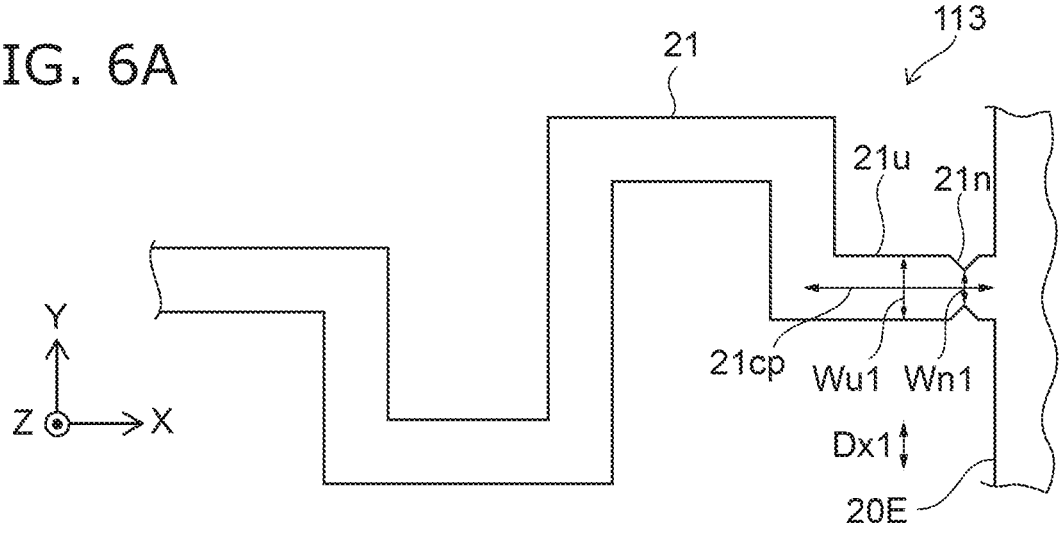
FIG. 6A and FIG. 6B are schematic plan views illustrating a MEMS element according to the first embodiment.
Figure 6B:
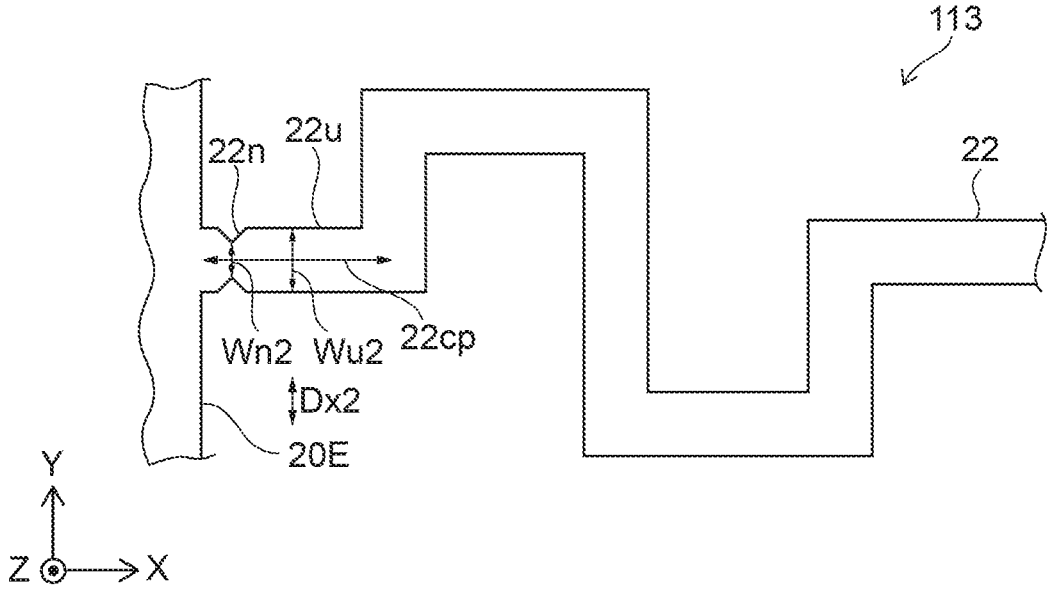

FIG. 6A and FIG. 6B are schematic plan views illustrating a MEMS element according to the first embodiment.

These drawings illustrate a portion of the MEMS element 113 according to the embodiment. FIG. 6A illustrates the first conductive member 21. FIG. 6B illustrates the second conductive member 22.

As shown in FIG. 6A, the first conductive member 21 may include a first notch portion 21*n* and a first non-notch portion 21*u*. For example, the direction from the first notch portion 21*n* toward the first non-notch portion 21*u* is along the first current path 21*cp* including the first conductive member 21 and the first movable electrode 20E.

A length Wn1 of the first notch portion 21*n* along a first cross direction Dx1 perpendicular to the first current path 21*cp* is less than a length Wu1 of the first non-notch portion 21*u* along the first cross direction Dx1. The first conductive member 21 easily breaks at the first notch portion 21*n*.

For example, it is favorable for the first notch portion 21*n* to be provided proximate to the first movable electrode 20E. Thereby, the first notch portion 21*n* breaks more easily when a portion of the first movable electrode 20E contacts the first fixed electrode 11. The distance between the first notch portion 21*n* and the first movable electrode 20E is short. For example, the distance between the first notch portion 21*n* and the first movable electrode 20E is not more than ½ of the first length of the first conductive member 21 along the first current path 21*cp* including the first conductive member 21 and the first movable electrode 20E (the sum of the lengths L11 to L17 of FIG. 4A). The distance between the first notch portion 21*n* and the first movable electrode 20E may be not more than 1/10 of the first length. The distance between the first notch portion 21*n* and the first movable electrode 20E may be not more than 1/20 of the first length. The first conductive member 21 breaks more easily.

As shown in FIG. 6B, the second conductive member 22 includes a second notch portion 22*n* and a second non-notch portion 22*u*. The direction from the second notch portion 22*n* toward the second non-notch portion 22*u* is along the second current path 22*cp* including the second conductive member 22 and the first movable electrode 20E. A length Wn2 of the second notch portion 22*n* along a second cross direction Dx2 perpendicular to the second current path 22*cp* is less than a length Wu2 of the second non-notch portion 22*u* along the second cross direction Dx2. The second conductive member 22 breaks more easily due to such a second notch portion 22*n*.

Figure 7A:
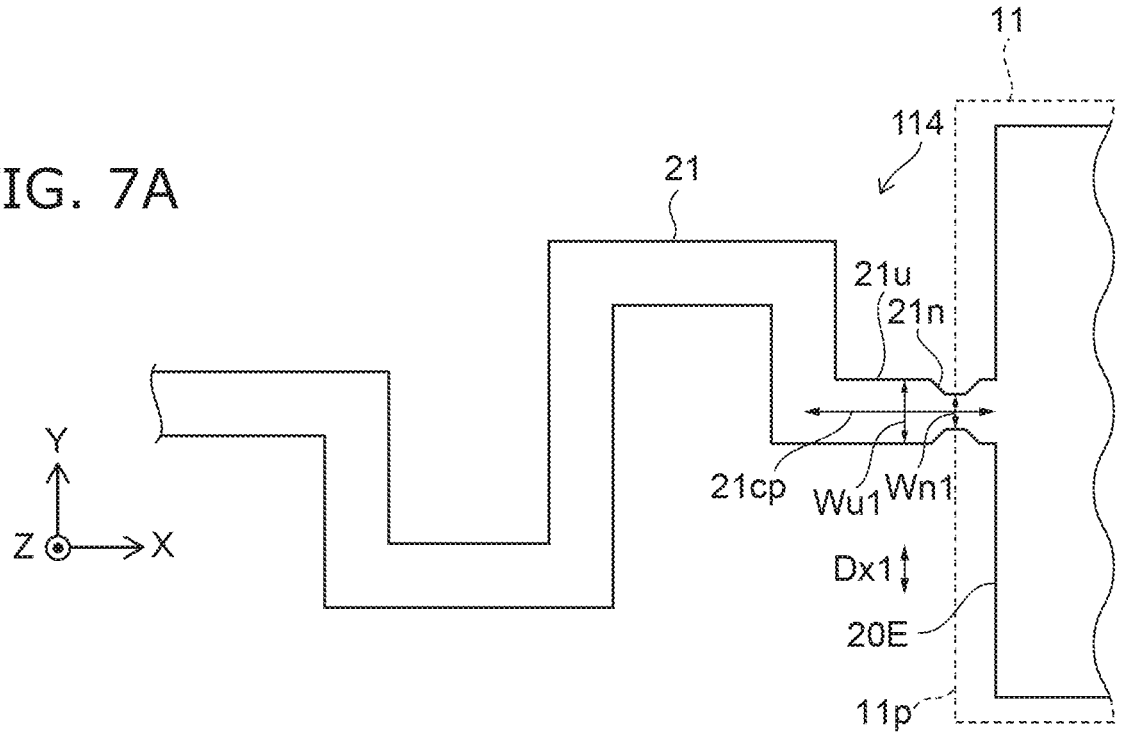
FIG. 7A and FIG. 7B are schematic plan views illustrating a MEMS element according to the first embodiment.
Figure 7B:
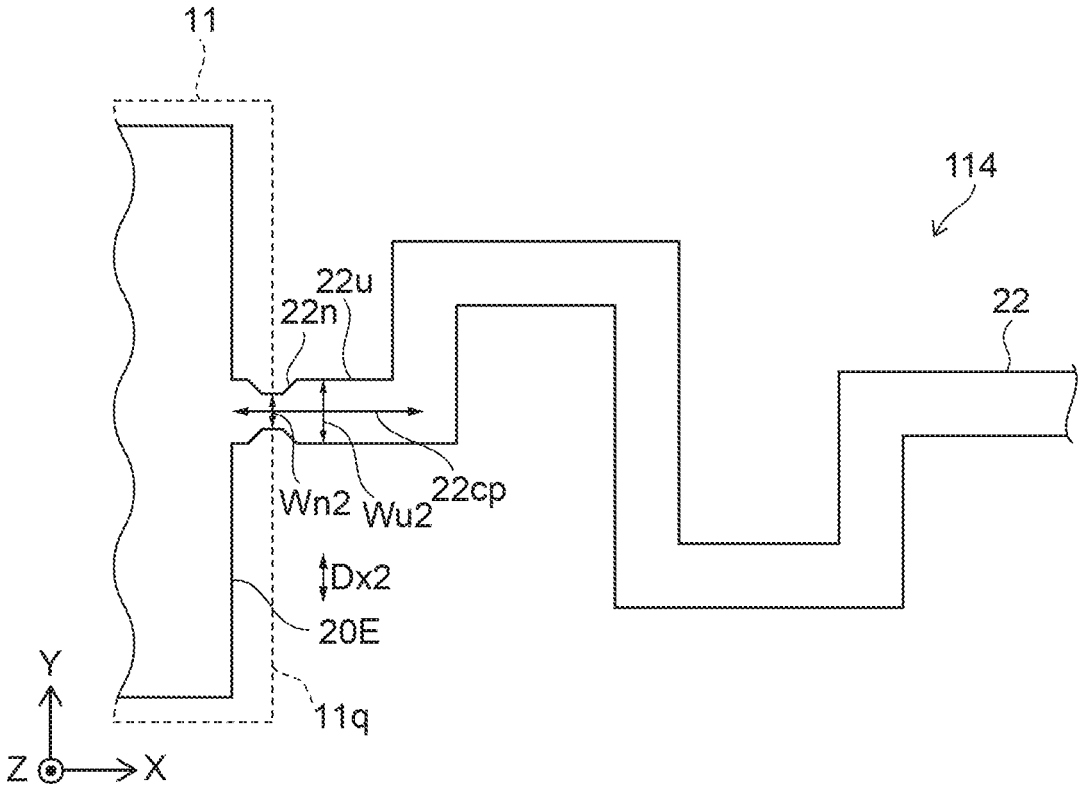

FIG. 7A and FIG. 7B are schematic plan views illustrating a MEMS element according to the first embodiment.

These drawings illustrate a portion of the MEMS element 114 according to the embodiment. FIG. 7A illustrates the first conductive member 21. FIG. 7B illustrates the second conductive member 22.

As shown in FIG. 7A, the first conductive member 21 includes the first notch portion 21*n* and the first non-notch portion 21*u*. The length Wn1 of the first notch portion 21*n* is less than the length Wu1 of the first non-notch portion 21*u*. In the MEMS element 114, the first notch portion 21*n* overlaps the end portion 11*p* of the first fixed electrode 11 in the first direction (the Z-axis direction), which is from the first fixed electrode 11 toward the first movable electrode 20E. The first notch portion 21*n* breaks more easily.

As shown in FIG. 7B, the second conductive member 22 includes the second notch portion 22*n* and the second non-notch portion 22*u*. The length Wn2 of the second notch portion 22*n* is less than the length Wu2 of the second non-notch portion 22*u*. In the MEMS element 114, the second notch portion 22*n* overlaps an end portion 11*q* of the first fixed electrode 11 in the first direction (the Z-axis direction), which is from the first fixed electrode 11 toward the first movable electrode 20E. The second notch portion 22*n* breaks more easily.

In the embodiment, the breakage of the first and second conductive members 21 and 22 is performed by, for example, a local temperature increase. In such a case, the compositions, etc., of these conductive members may change. Such examples will now be described.

Figure 8A:
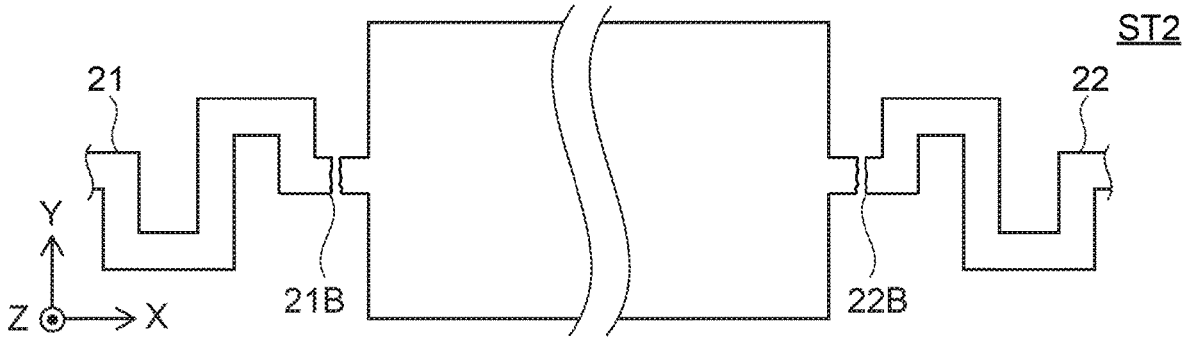
FIG. 8A to FIG. 8C are schematic plan views illustrating a MEMS element according to the first embodiment.
Figure 8B:
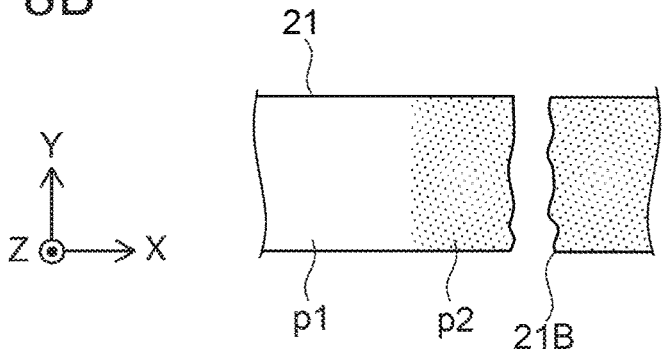
Figure 8C:
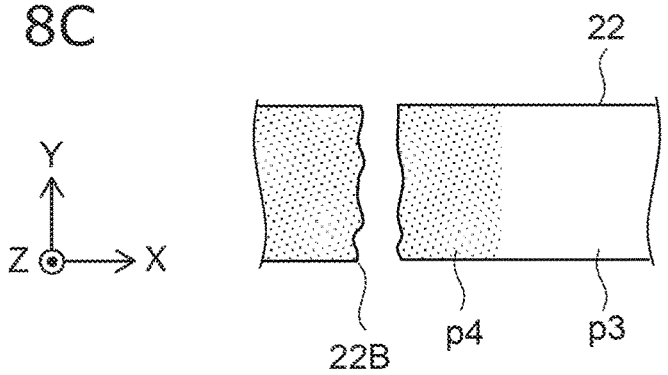

FIG. 8A to FIG. 8C are schematic plan views illustrating the MEMS element according to the first embodiment.

In the second state ST2 as shown in FIG. 8A, the break portion 21B of the first conductive member 21 is formed, and the break portion 22B is formed in the second conductive member 22. FIG. 8B illustrates the break portion 21B. FIG. 8C illustrates the break portion 22B.

In the second state ST2 as shown in FIG. 8B, the first conductive member 21 includes a first portion p1 and a second portion p2. The distance between the break portion 21B and the first portion p1 of the first conductive member 21 is greater than the distance between the break portion 21B and the second portion p2 of the first conductive member 21. The second portion p2 is proximate to the break portion 21B. The first portion p1 is far from the break portion 21B. For example, there are cases where the color or the like of the second portion p2 is different from that of the first portion p1 due to a high temperature, etc. For example, the second portion p2 may have at least one of a different light reflectance from the light reflectance of the first portion p1, a different color from the color of the first portion p1, a different unevenness from the unevenness of the first portion p1, a different composition from the composition of the first portion p1, or a different oxygen concentration from the oxygen concentration included in the first portion p1. There are cases where differences occur between the first portion p1 and the second portion p2 such as those recited above when the break occurs due to the effects of heat, etc.

In the second state ST2 as shown in FIG. 8C, the second conductive member 22 includes a third portion p3 and a fourth portion p4. The distance between the break portion 22B and the third portion p3 of the second conductive member 22 is greater than the distance between the break portion 22B and the fourth portion p4 of the second conductive member 22. The fourth portion p4 is proximate to the break portion 22B. The third portion p3 is far from the break portion 22B. For example, the fourth portion p4 may have at least one of a different light reflectance from the light reflectance of the third portion p3, a different color from the color of the third portion p3, a different unevenness from the unevenness of the third portion p3, a different composition from the composition of the third portion p3, or a different oxygen concentration from the oxygen concentration included in the third portion p3. There are cases where differences between the third portion p3 and the fourth portion p4 occur such as those recited above when the breakage occurs due to the effects of heat, etc.

Figure 9:
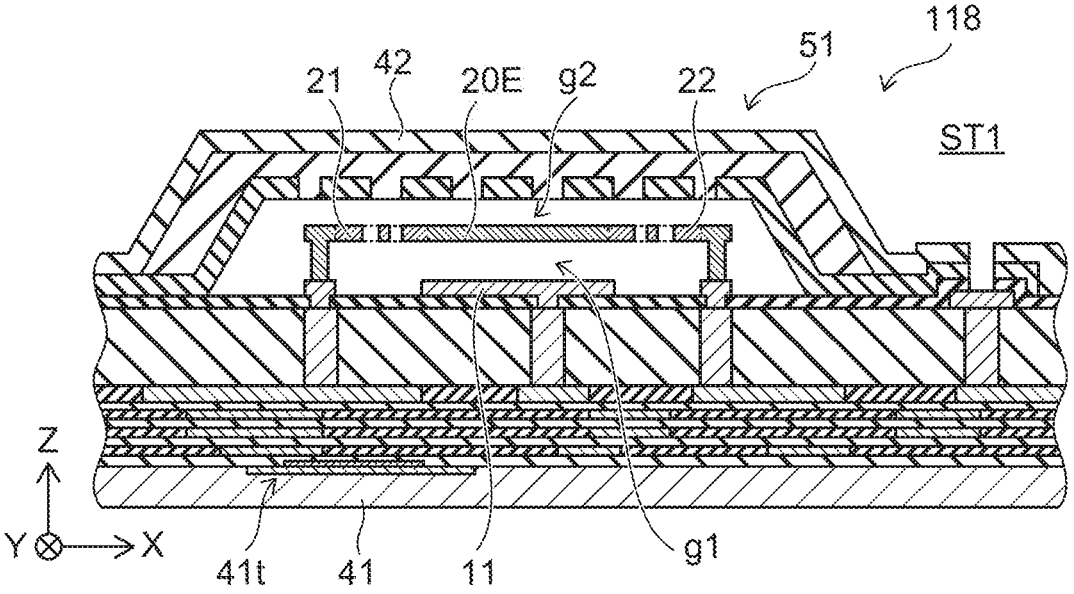
FIG. 9 is a schematic cross-sectional view illustrating a MEMS element according to the first embodiment.

FIG. 9 is a schematic cross-sectional view illustrating a MEMS element according to the first embodiment.

FIG. 9 illustrates the MEMS element 118 according to the embodiment. FIG. 9 illustrates the first state ST1. As shown in FIG. 9, the MEMS element 118 further includes a second member 42 in addition to the element part 51. The first fixed electrode 11 and the first movable electrode 20E are between the first member 41 and the second member 42. In the first state ST1, the first gap g1 is between the first fixed electrode 11 and the first movable electrode 20E. In the first state ST1, a second gap g2 is between the first movable electrode 20E and the second member 42.

The second member 42 is, for example, a cap. The first movable electrode 20E can be displaced along the Z-axis direction due to the first and second gaps g1 and g2. For example, the first gap g1 and the second gap g2 may be in a reduced-pressure state. For example, an inert gas may be introduced to the first and second gaps g1 and g2.

For example, the first member 41 may include a control circuit part 41*t*. The control circuit part 41*t* includes, for example, a switching element such as a transistor, etc. The application of the first electrical signal Sg1 to the first fixed electrode 11 may be controlled by the control circuit part 41*t*.

Second Embodiment

Figure 10A:
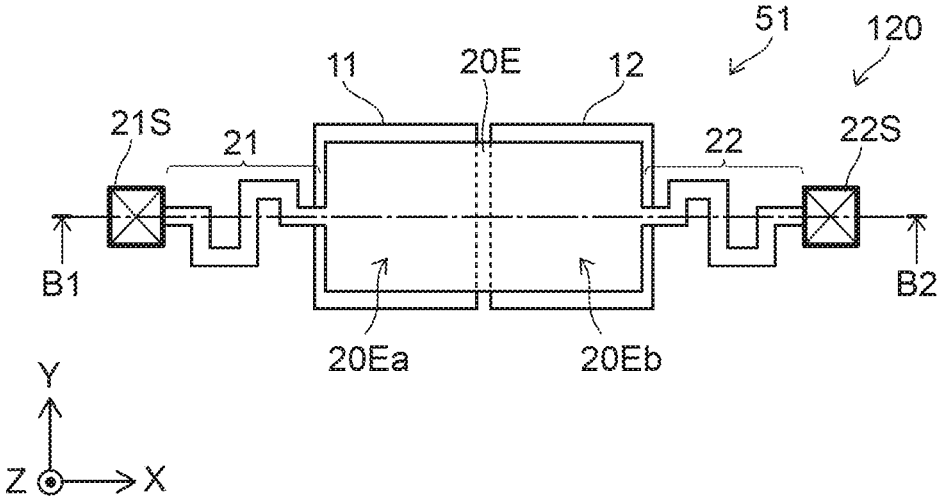
FIG. 10A and FIG. 10B are schematic views illustrating a MEMS element according to a second embodiment.
Figure 10B:
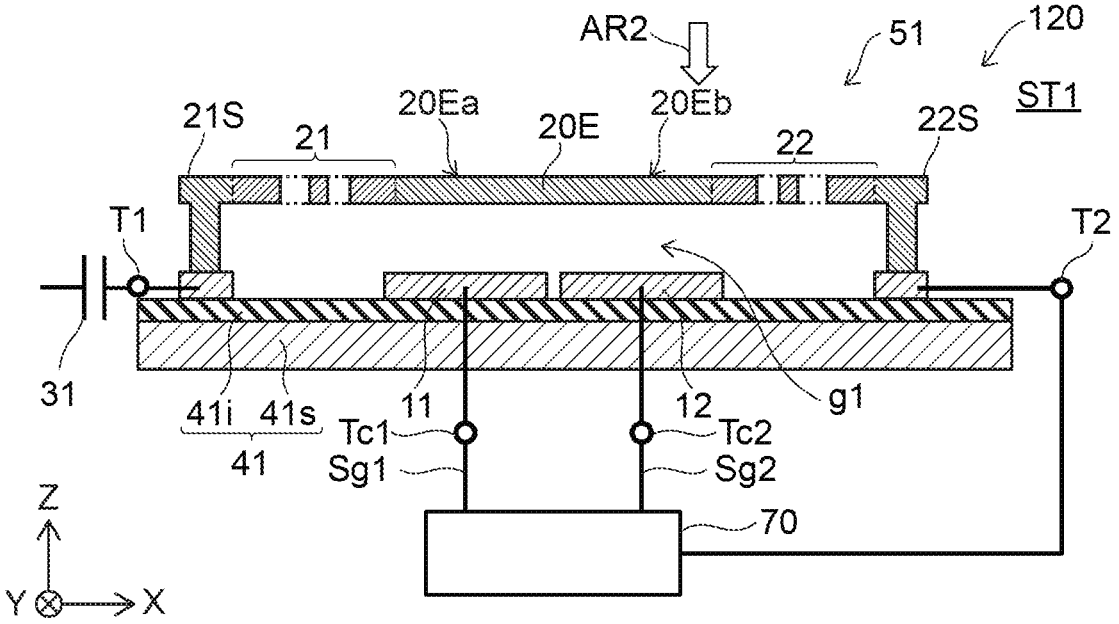

FIG. 10A and FIG. 10B are schematic views illustrating a MEMS element according to a second embodiment.

FIG. 10A is a plan view as viewed along arrow AR2 of FIG. 10B. FIG. 10B is a line B1-B2 cross-sectional view of FIG. 10A.

As shown in FIG. 10B, the MEMS element 120 according to the embodiment also includes the first member 41 and the element part 51. In the MEMS element 120, the element part 51 includes a second fixed electrode 12 in addition to the first fixed electrode 11, the first movable electrode 20E, the first conductive member 21, and the second conductive member 22. The configurations of the first fixed electrode 11, the first movable electrode 20E, the first conductive member 21, and the second conductive member 22 in the MEMS element 120 may be similar to these configurations in the first embodiment. The second fixed electrode 12 will now be described.

As shown in FIG. 10B, the second fixed electrode 12 is fixed to the first member 41. The first movable electrode 20E includes a first electrode region 20Ea and a second electrode region 20Eb. The distance between the first electrode region 20Ea and the first conductive member 21 is less than the distance between the second electrode region 20Eb and the first conductive member 21. The first electrode region 20Ea is the region at the first conductive member 21 side. The second electrode region 20Eb is the region at the second conductive member 22 side.

The first electrode region 20Ea faces the first fixed electrode 11. The second electrode region 20Eb faces the second fixed electrode 12.

For example, the controller 70 can be electrically connected to the first fixed electrode 11 via the first control terminal Tc1. The controller 70 can be electrically connected to the second fixed electrode 12 via a second control terminal Tc2. In the example, the controller 70 is electrically connected to the second conductive member 22 via the second terminal T2. For example, a second electrical signal Sg2 can be applied between the second conductive member 22 and the second fixed electrode 12 by the controller 70.

FIG. 10B corresponds to the first state ST1. The first state ST1 is the state before the second electrical signal Sg2 is applied between the second conductive member 22 and the second fixed electrode 12. In the first state ST1, the first conductive member 21 and the second conductive member 22 support the first movable electrode 20E to be separated from the second fixed electrode 12. In the first state ST1 as described above, the first conductive member 21 and the second conductive member 22 support the first movable electrode 20E to be separated from the first fixed electrode 11.

For example, the second state ST2 is the state after the second electrical signal Sg2 is applied between the second conductive member 22 and the second fixed electrode 12. As described below, in the second state ST2, the first conductive member 21 and the second conductive member 22 are in a broken state.

As described below, the first conductive member 21 and the second conductive member 22 can be broken more stably by providing the first fixed electrode 11 and the second fixed electrode 12 in the MEMS element 120. In the second embodiment as well, a MEMS element can be provided in which a stable operation is possible.

An example of the transition from the first state ST1 to the second state ST2 will now be described.

FIG. 11A to FIG. 11C, FIG. 12A and FIG. 12B are schematic cross-sectional views illustrating the MEMS element according to the second embodiment.

Figure 11A:
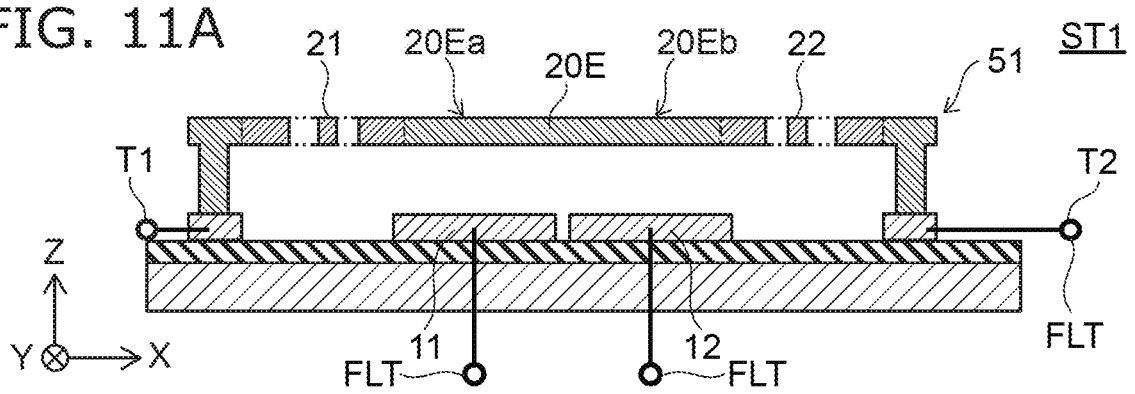
FIG. 11A to FIG. 11C are schematic cross-sectional views illustrating the MEMS element according to the second embodiment.

In the first state ST1 shown in FIG. 11A, for example, an electrical signal for control is not applied between the second conductive member 22 and the first fixed electrode 11 or between the second conductive member 22 and the second fixed electrode 12. For example, the second conductive member 22, the first fixed electrode 11, and the second fixed electrode 12 are in the floating state FLT. At this time, the first movable electrode 20E is separated from the first fixed electrode 11 and the second fixed electrode 12. In such a first state ST1, a current can flow between the first terminal T1 and the second terminal T2. In the first state ST1, the element part 51 is in the conducting state (the on-state).

Figure 11B:
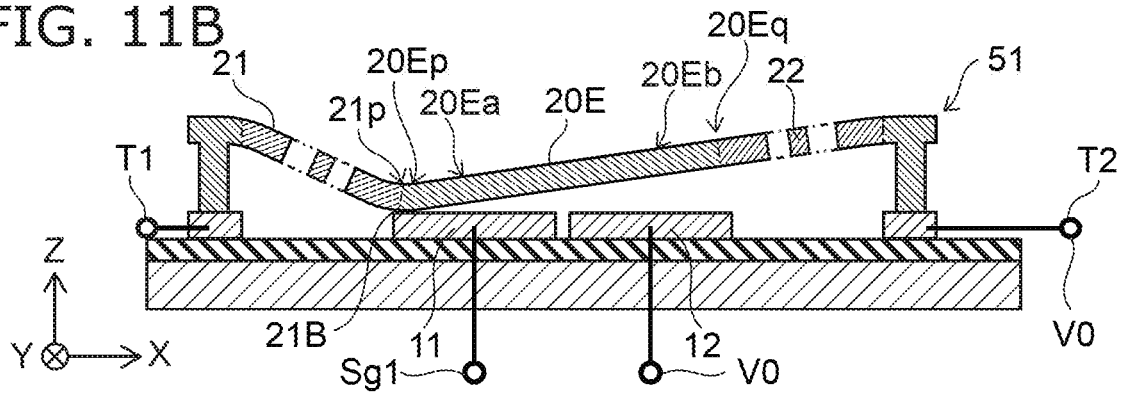

As shown in FIG. 11B, for example, the second terminal T2 (the second conductive member 22) is set to the ground potential V0, and the first electrical signal Sg1 is applied to the first fixed electrode 11. At this time, for example, the second fixed electrode 12 is set to the ground potential V0. Thereby, the first electrode region 20Ea of the first movable electrode 20E contacts the first fixed electrode 11. At this time, a state can be formed in which the second electrode region 20Eb is separated from the second fixed electrode 12. The temperature of the first conductive member 21 at the vicinity of the end portion 20Ep of the first movable electrode 20E is easily increased locally thereby. For example, the rise of the temperature is due to Joule heat.

When the temperatures of the end portions 20Ep and 21*p* locally rise, the first conductive member 21 breaks, and the break portion 21B is formed as shown in FIG. 11B.

Figure 11C:
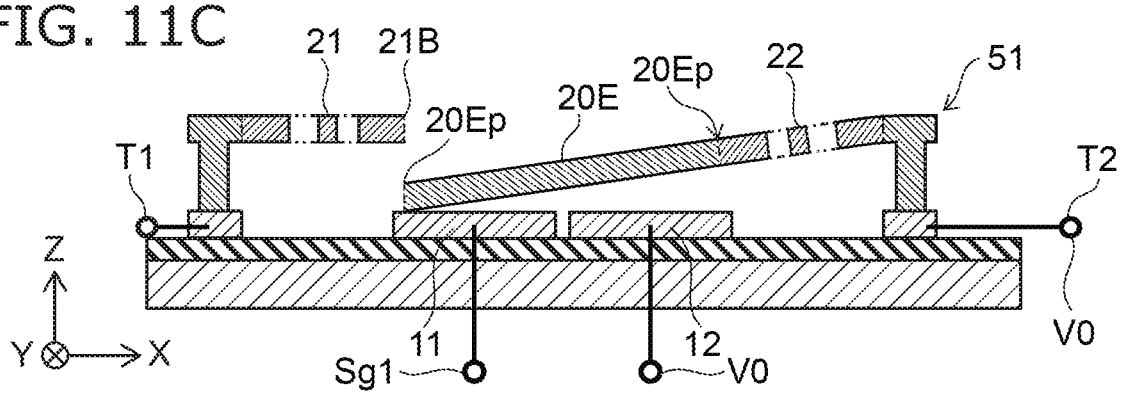

As shown in FIG. 11C, the broken first conductive member 21 may approach the state of FIG. 11A. For example, this is due to the restoring force due to the elasticity of the first conductive member 21. As shown in FIG. 11C, the end portion 20Ep of the first movable electrode 20E is separated from the first conductive member 21. Thus, the first conductive member 21 is divided.

For example, when a portion of the first conductive member 21 overlaps the first fixed electrode 11 in the Z-axis direction, the end portion 21*p* of the first conductive member 21 easily contacts the first fixed electrode 11 when the first movable electrode 20E approaches the first fixed electrode 11. A current locally flows between the end portion 21*p* and the first fixed electrode 11. The temperature of the end portion 21*p* easily rises locally. The first conductive member 21 breaks more stably.

Figure 12A:
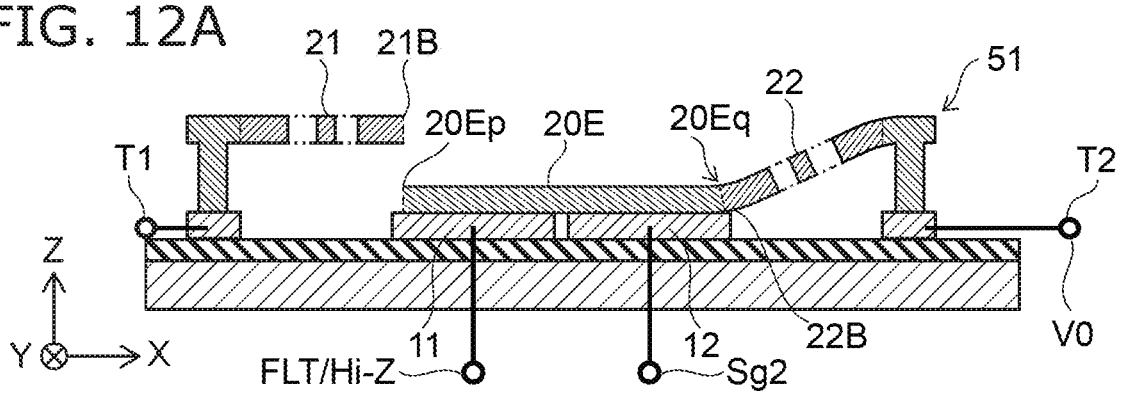
FIG. 12A and FIG. 12B are schematic cross-sectional views illustrating the MEMS element according to the second embodiment.

As shown in FIG. 12A, for example, the second terminal T2 (the second conductive member 22) is set to the ground potential V0, and the second electrical signal Sg2 is applied to the second fixed electrode 12. At this time, for example, the first fixed electrode 11 is set to the floating state FLT or a high-impedance state Hi-Z. For example, a current does not flow between the first fixed electrode 11 and the second fixed electrode 12. The temperature of the second conductive member 22 rises, and the second conductive member 22 breaks. For example, the rise of the temperature is due to Joule heat. The second conductive member 22 is divided at the break portion 22B. The application of the second electrical signal Sg2 ends.

Figure 12B:
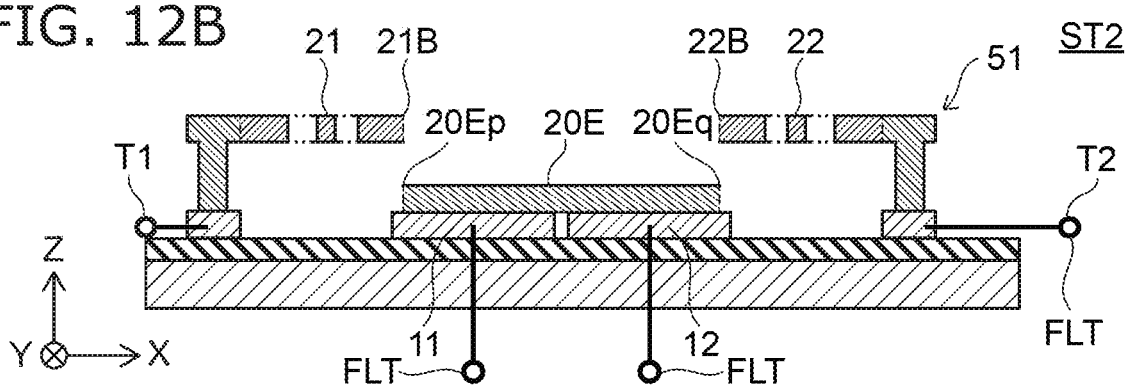

As shown in FIG. 12B, the broken second conductive member 22 may approach the state of FIG. 11A. For example, this is due to the restoring force due to the elasticity of the second conductive member 22. As shown in FIG. 12B, the end portion 20Eq of the first movable electrode 20E is separated from the second conductive member 22.

In the second state ST2 shown in FIG. 12B, for example, the second conductive member 22, the first fixed electrode 11, and the second fixed electrode 12 are in the floating state FLT. The broken states of the first and second conductive members 21 and 22 continue even after the application of the first electrical signal Sg1 and the second electrical signal Sg2 has ended. In the second state ST2, a current does not flow between the first terminal T1 and the second terminal T2. In the second state ST2, the element part 51 is in the nonconducting state (the off-state).

Thus, in the MEMS element 120 according to the embodiment, both the first conductive member 21 and the second conductive member 22 are in a broken state in the second state ST2. The current that flows between the first terminal T1 and the second terminal T2 can be stably blocked thereby.

Figure 13:
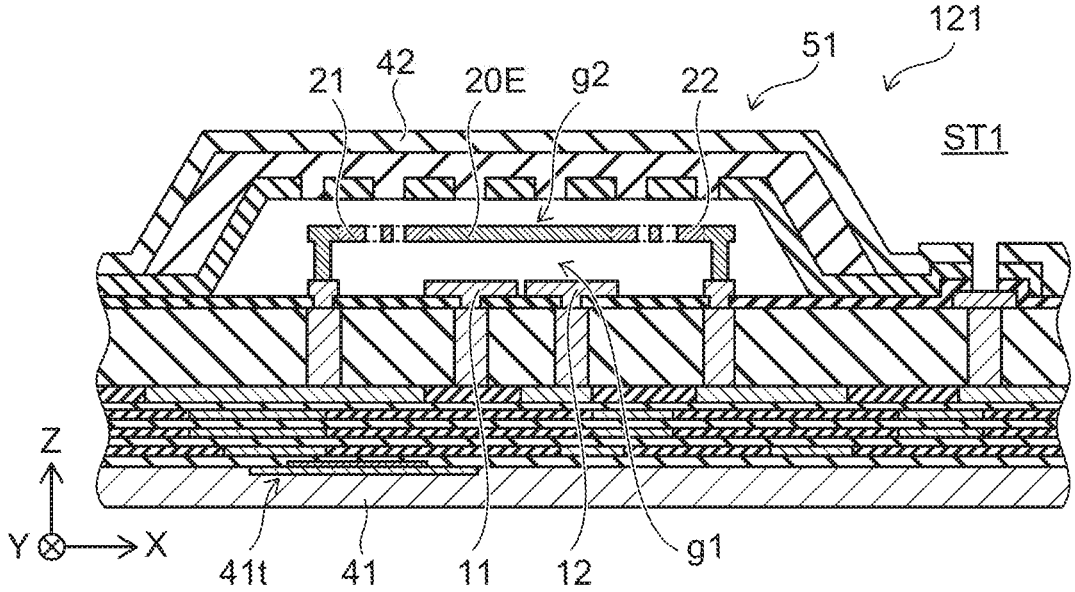
FIG. 13 is a schematic cross-sectional view illustrating a MEMS element according to the second embodiment.

FIG. 13 is a schematic cross-sectional view illustrating a MEMS element according to the second embodiment.

FIG. 13 illustrates the MEMS element 121 according to the embodiment. FIG. 13 illustrates the first state ST1. As shown in FIG. 13, the MEMS element 121 includes the first member 41, the second member 42, and the element part 51. The first fixed electrode 11, the second fixed electrode 12, and the first movable electrode 20E are between the first member 41 and the second member 42. In the first state ST1, the first gap g1 is between the first fixed electrode 11 and the first movable electrode 20E and between the second fixed electrode 12 and the first movable electrode 20E. In the first state ST1, the second gap g2 is between the first movable electrode 20E and the second member 42. The first movable electrode 20E can be displaced along the Z-axis direction due to the first and second gaps g1 and g2.

It is favorable for the electrical resistances of the first and second conductive members 21 and 22 in the first and second embodiments to be, for example, 10Ω or less. By setting the electrical resistance to be low, a signal that has a high frequency can be efficiently transmitted with low loss.

In the first and second embodiments, for example, at least one of the first conductive member 21 or the second conductive member 22 includes at least one selected from the group consisting of Al, Cu, Au, Ti, Pd, Pt, and W. A low resistance is obtained, and good transmission in the element part 51 is obtained.

Figure 14A:
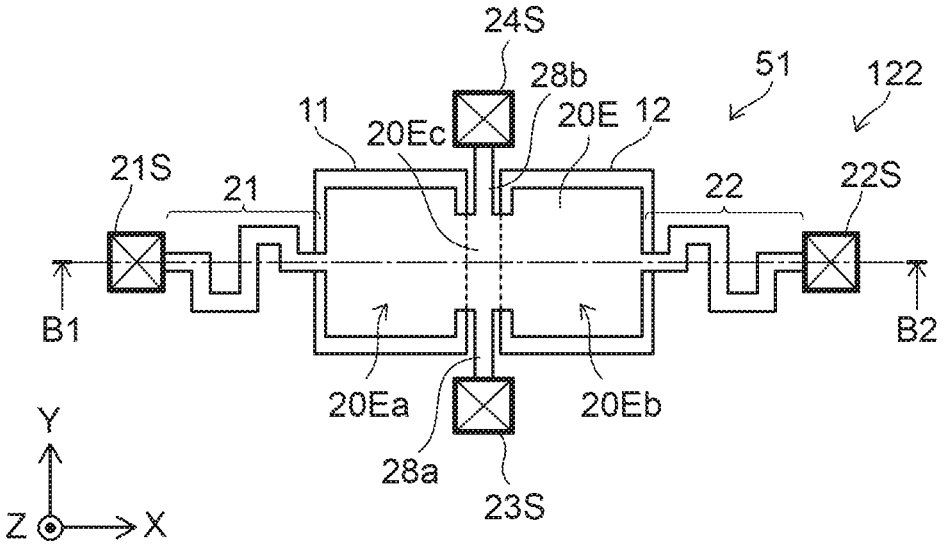
FIG. 14A and FIG. 14B are schematic views illustrating a MEMS element according to the second embodiment.
Figure 14B:
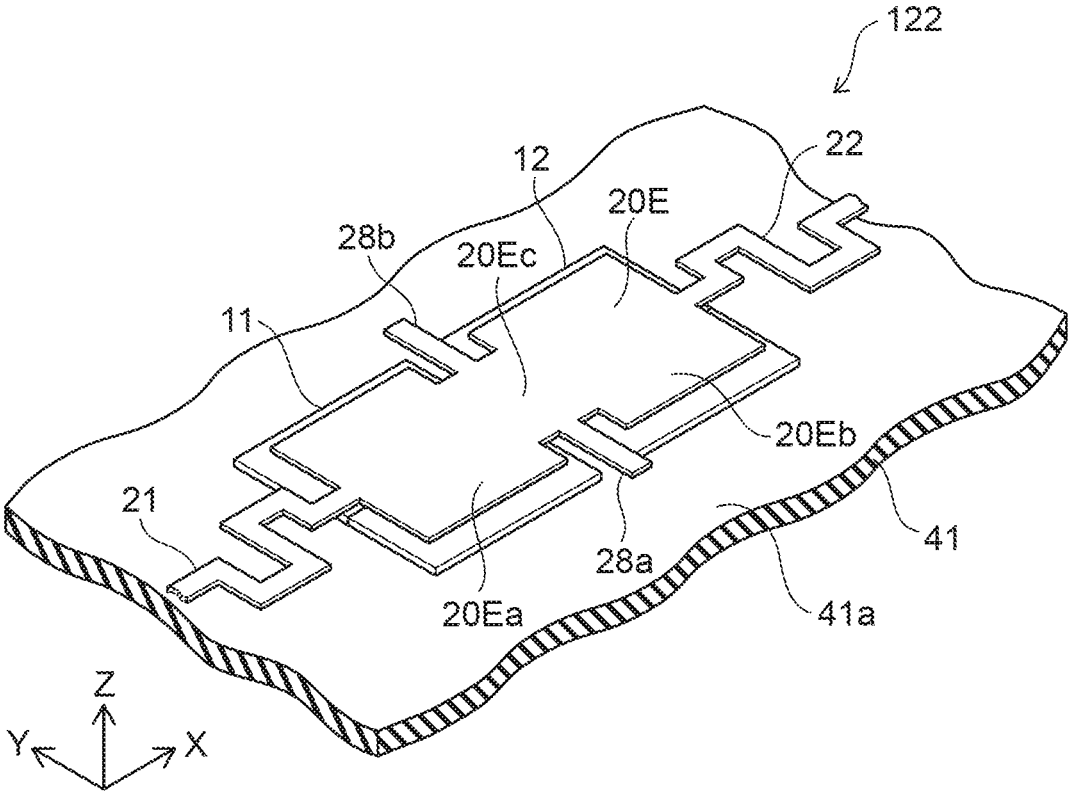

FIG. 14A and FIG. 14B are schematic views illustrating a MEMS element according to the second embodiment.

FIG. 14A is a plan view. FIG. 14B is a perspective view.

As shown in FIG. 14B, the MEMS element 122 according to the embodiment also includes the first member 41 and the element part 51. In the MEMS element 122, the element part 51 includes the first fixed electrode 11, the first movable electrode 20E, the second fixed electrode 12, the first conductive member 21, and the second conductive member 22. The configurations of the first movable electrode 20E and the supporters in the MEMS element 122 are different from the configurations of the first movable electrode 20E and the supporters in the MEMS element 120. An example of the configurations of the first movable electrode 20E and the supporters in the MEMS element 122 will now be described.

In the MEMS element 122 as shown in FIG. 14A and FIG. 14B, the first movable electrode 20E further includes a third electrode region 20Ec in addition to the first electrode region 20Ea and the second electrode region 20Eb. The third electrode region 20Ec is between the first electrode region 20Ea and the second electrode region 20Eb.

The element part 51 includes the first supporter 21S, the second supporter 22S, and a third supporter 23S. The first supporter 21S, the second supporter 22S, and the third supporter 23S are fixed to the first member 41. The first supporter 21S, the second supporter 22S, and the third supporter 23S are not illustrated in FIG. 14B.

The first supporter 21S supports at least a portion of the first conductive member 21 to be separated from the first member 41. The second supporter 22S supports at least a portion of the second conductive member 22 to be separated from the first member 41. The third supporter 23S supports at least a portion of the third electrode region 20Ec to be separated from the first member 41.

For example, the third electrode region 20Ec may be a portion including the X-axis direction center of the first movable electrode 20E. For example, the third electrode region 20Ec is at the central portion between the first conductive member 21 and the second conductive member 22. In the MEMS element 122, at least a portion of the third electrode region 20Ec is supported to be separated from the first member 41. Thereby, for example, the distance between the second electrode region 20Eb and the second fixed electrode 12 increases when the distance between the first electrode region 20Ea and the first fixed electrode 11 decreases. Both the first conductive member 21 and the second conductive member 22 break more easily and more stably. Examples of operations of the MEMS element 122 are described below.

In the example, the first movable electrode 20E includes a first extension region 28*a*. The first extension region 28*a* extends along an extension direction. The extension direction is along a surface 41*a* of the first member 41 and crosses the direction (in the example, the X-axis direction) from the first electrode region 20Ea toward the second electrode region 20Eb. In the example, the extension direction is the Y-axis direction.

A portion (e.g., an end) of the first extension region 28*a* is connected to the third electrode region 20Ec. Another portion (e.g., another end) of the first extension region 28*a* is connected to the third supporter 23S.

Thus, the third supporter 23S may support at least a portion of the third electrode region 20Ec via the first extension region 28*a* to be separated from the first member 41.

In the example, the first movable electrode 20E includes a second extension region 28*b*. The third electrode region 20Ec is between the first extension region 28*a* and the second extension region 28*b* in the extension direction recited above (e.g., the Y-axis direction).

The element part 51 further includes a fourth supporter 24S fixed to the first member 41. A portion (e.g., an end) of the second extension region 28*b* is connected to the third electrode region 20Ec. Another portion (e.g., another end) of the second extension region 28*b* is connected to the fourth supporter 24S.

Thus, the fourth supporter 24S may support at least a portion of the third electrode region 20Ec via the second extension region 28*b* to be separated from the first member 41.

For example, the third supporter 23S and the fourth supporter 24S may be electrically insulated from the first movable electrode 20E. The first electrode region 20Ea, the second electrode region 20Eb, the third electrode region 20Ec, the first extension region 28*a*, and the second extension region 28*b* may be a continuous conductive layer. For example, the first extension region 28*a* and the second extension region 28*b* may function as a torsion spring.

Examples of operations of the MEMS element 122 will now be described.

FIG. 15A to FIG. 15C and FIG. 16A to FIG. 16C are schematic cross-sectional views illustrating the MEMS element according to the second embodiment.

These drawings correspond to a line B1-B2 cross section of FIG. 14A.

Figure 15A:
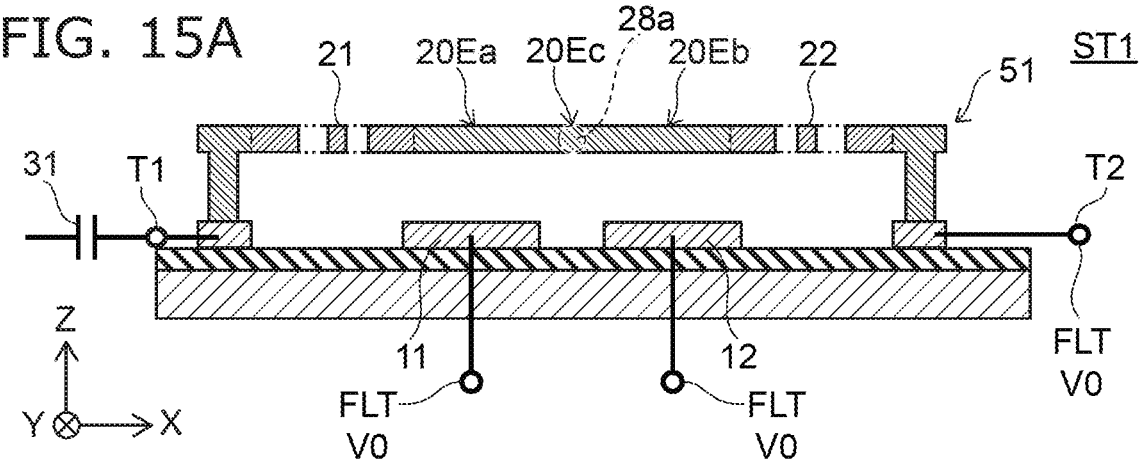
FIG. 15A to FIG. 15C are schematic cross-sectional views illustrating the MEMS element according to the second embodiment.

In the first state ST1 shown in FIG. 15A, for example, the second conductive member 22, the first fixed electrode 11, and the second fixed electrode 12 are set to the floating state FLT or the ground potential V0. In the first state ST1, the element part 51 is in the conducting state (the on-state).

Figure 15B:
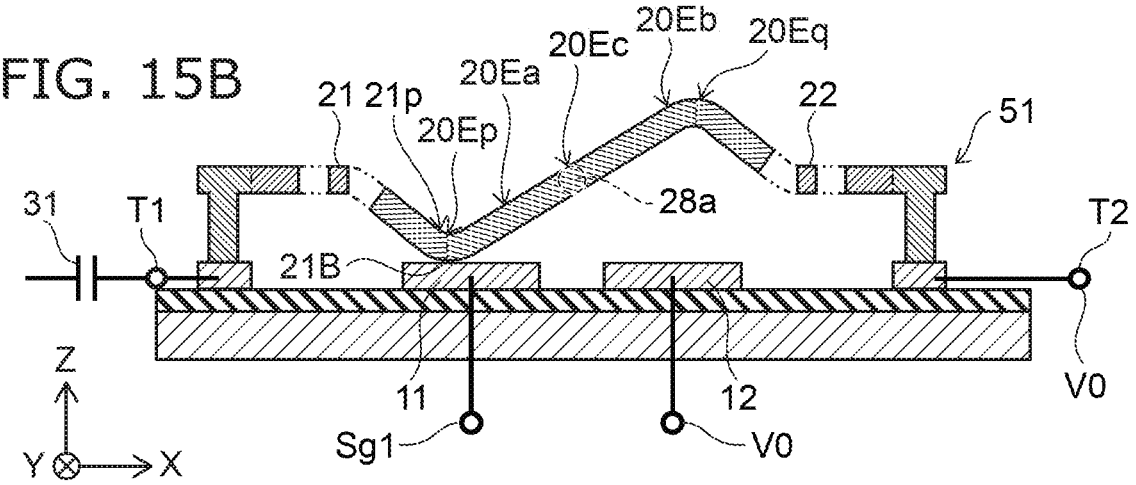

As shown in FIG. 15B, for example, the second terminal T2 (the second conductive member 22) is set to the ground potential V0, and the first electrical signal Sg1 is applied to the first fixed electrode 11. The first electrode region 20Ea contacts the first fixed electrode 11. Because the third electrode region 20Ec is supported via the first extension region 28*a* to be separated from the first member 41, the distance between the second electrode region 20Eb and the second fixed electrode 12 increases. The temperature of the first conductive member 21 at the vicinity of the end portion 20Ep of the first movable electrode 20E easily rises locally.

When the temperature of the end portion 20Ep and the end portion 21*p* locally rises, the first conductive member 21 breaks and the break portion 21B is formed as shown in FIG. 15B.

Figure 15C:
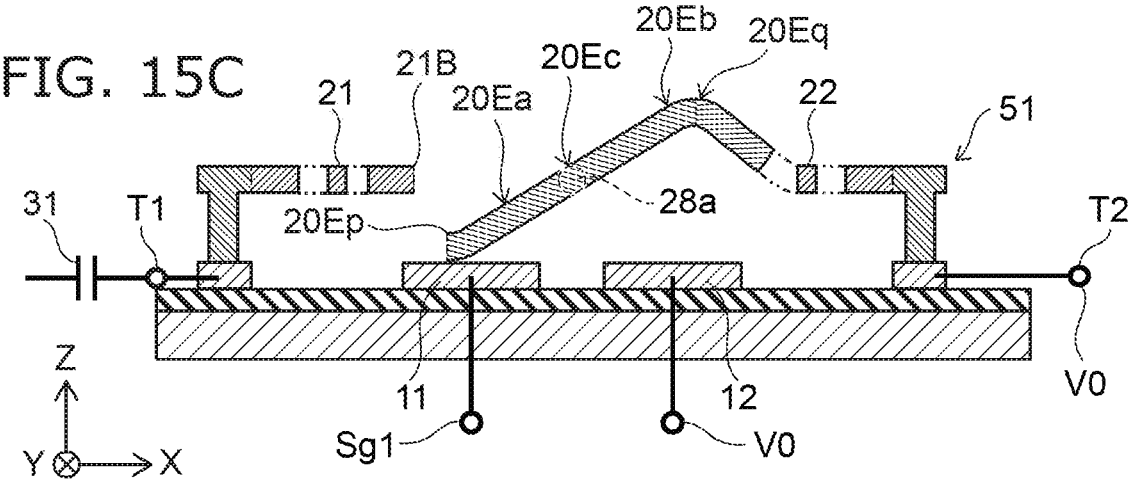

As shown in FIG. 15C, the broken first conductive member 21 may approach the state of FIG. 11A due to the restoring force due to the elasticity of the first conductive member 21.

Figure 16A:
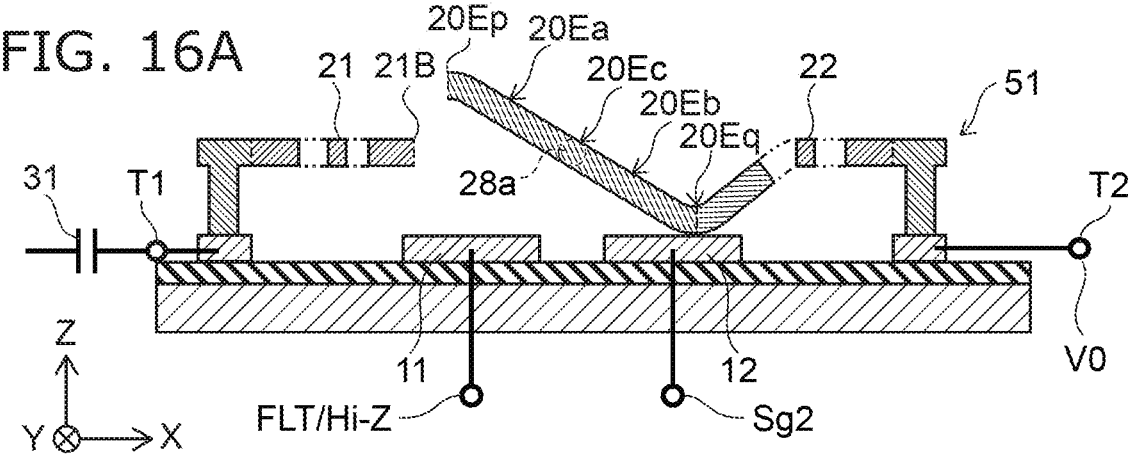
FIG. 16A to FIG. 16C are schematic cross-sectional views illustrating the MEMS element according to the second embodiment.

As shown in FIG. 16A, for example, the second terminal T2 (the second conductive member 22) is set to the ground potential V0, and the second electrical signal Sg2 is applied to the second fixed electrode 12. At this time, for example, the first fixed electrode 11 is set to the ground potential V0 or the high-impedance state Hi-Z. The temperature of the second conductive member 22 rises, and the second conductive member 22 breaks. The second conductive member 22 is divided at the break portion 22B. The application of the second electrical signal Sg2 ends.

Figure 16B:
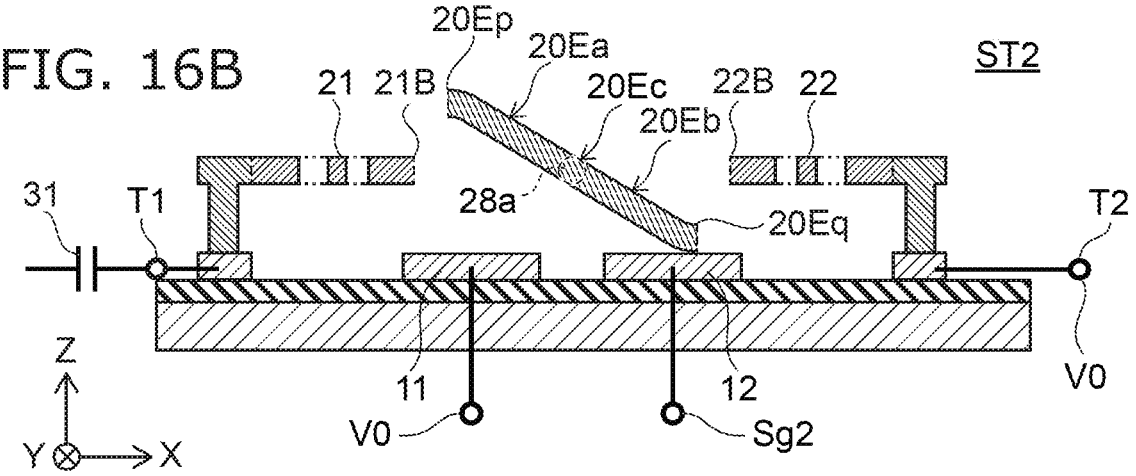

As shown in FIG. 16B, the broken second conductive member 22 may approach the state of FIG. 16A due to the restoring force due to the elasticity of the second conductive member 22.

Figure 16C:
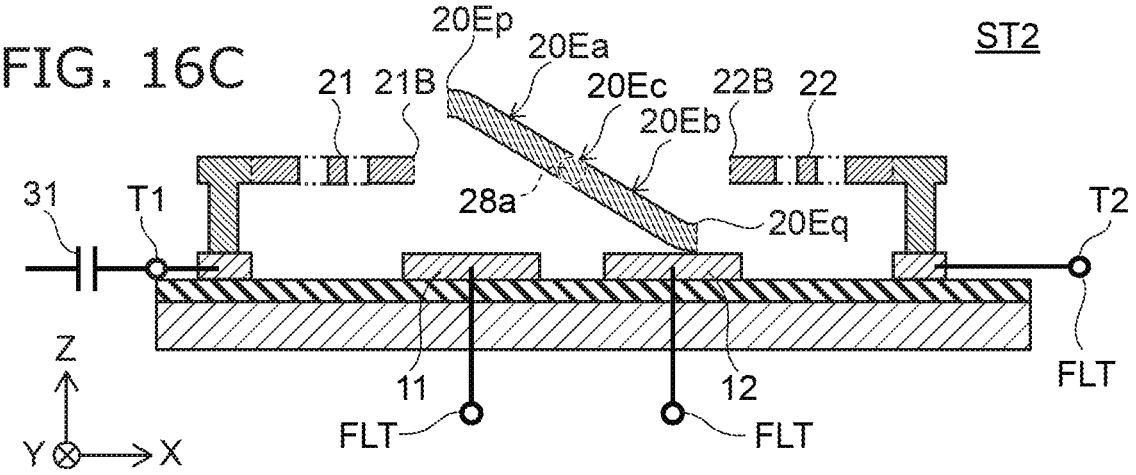

In the second state ST2 shown in FIG. 16C, for example, the second conductive member 22, the first fixed electrode 11, and the second fixed electrode 12 are in the floating state FLT. In the second state ST2, the element part 51 is in the nonconducting state (the off-state).

In the MEMS element 122, both the first conductive member 21 and the second conductive member 22 break easily in the second state ST2. The current that flows between the first terminal T1 and the second terminal T2 can be stably blocked.

Figure 17A:
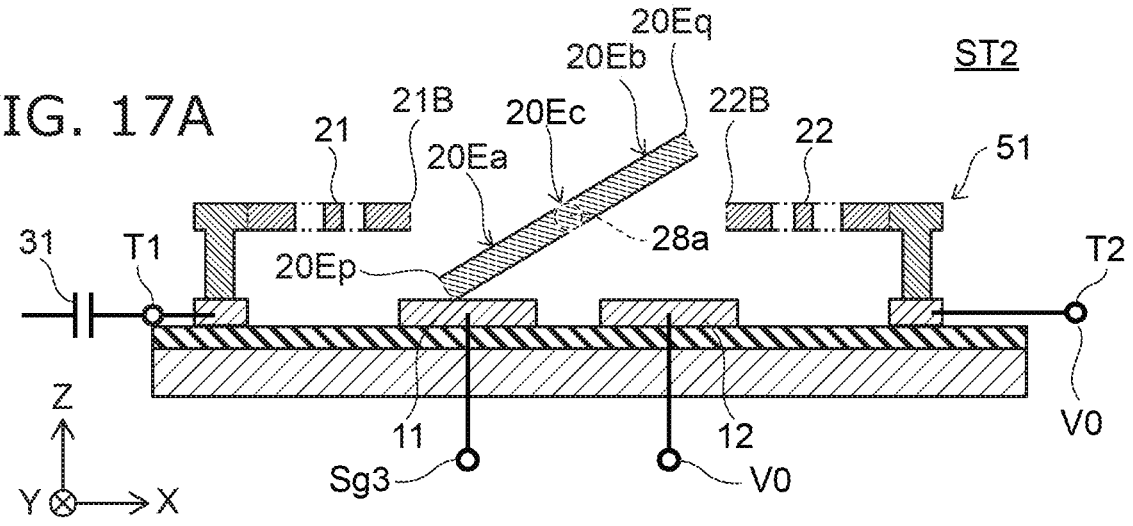
FIG. 17A and FIG. 17B are schematic cross-sectional views illustrating the MEMS element according to the embodiment.
Figure 17B:
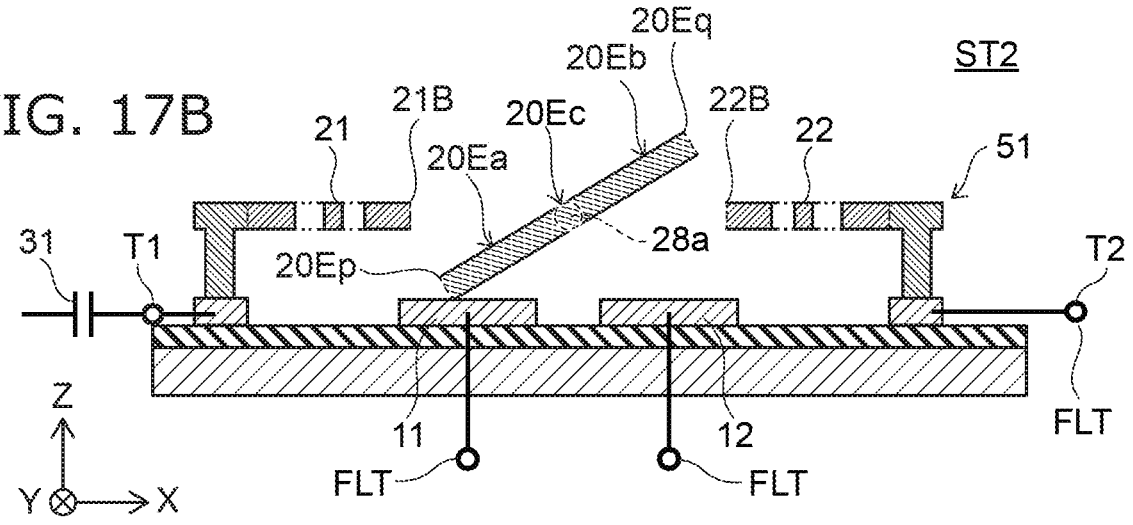

FIG. 17A and FIG. 17B are schematic cross-sectional views illustrating the MEMS element according to the embodiment. These drawings illustrate another operation of the MEMS element 122. These drawings illustrate an operation after the operation described in reference to FIG. 15A to FIG. 15C is performed.

As shown in FIG. 17A, for example, the second terminal T2 (the second conductive member 22) is set to the ground potential V0, and a third electrical signal Sg3 is applied to the first fixed electrode 11. For example, the absolute value of the third electrical signal Sg3 is greater than the absolute value of the first electrical signal Sg1. The second conductive member 22 is broken thereby. As shown in FIG. 17A, the broken second conductive member 22 may approach the state of FIG. 15C due to the restoring force due to the elasticity of the second conductive member 22.

In the second state ST2 shown in FIG. 17B, for example, the second conductive member 22, the first fixed electrode 11, and the second fixed electrode 12 are in the floating state FLT. In the second state ST2, the element part 51 is in the nonconducting state (the off-state).

The configuration in which at least a portion of the third electrode region 20Ec is supported to be separated from the first member 41 may be applied to a configuration in which the second fixed electrode 12 is not provided. For example, the third electrode region 20Ec, the first extension region 28*a*, the second extension region 28*b*, the third supporter 23S, the fourth supporter 24S, etc., described in reference to the MEMS element 122 (referring to FIG. 14A) may be provided in the MEMS element 110 illustrated in FIG. 1A and FIG. 18.

For example, in the MEMS element 110, the first movable electrode 20E may include the first electrode region 20Ea, the second electrode region 20Eb, and the third electrode region 20Ec (referring to FIG. 14A). The first electrode region 20Ea is between the first conductive member 21 and the second conductive member 22. The second electrode region 20Eb is between the first electrode region 20Ea and the second conductive member 22. The third electrode region 20Ec is between the first electrode region 20Ea and the second electrode region 20Eb. The element part 51 includes the first supporter 21S that is fixed to the first member 41, the second supporter 22S that is fixed to the first member 41, and the third supporter 23S that is fixed to the first member 41. The first supporter 21S supports at least a portion of the first conductive member 21 to be separated from the first member 41. The second supporter 22S supports at least a portion of the second conductive member 22 to be separated from the first member 41. The third supporter 23S supports at least a portion of the third electrode region 20Ec to be separated from the first member 41. More stable breakage is obtained. In such a case, for example, the operation described in reference to FIG. 15A to FIG. 15C, FIG. 16A and FIG. 16B may be performed. In the example, the surface area of the portion of the first electrode region 20Ea facing the first fixed electrode 11 may be greater than the surface area of the portion of the second electrode region 20Eb facing the first fixed electrode 11.

Third Embodiment

Figure 18:
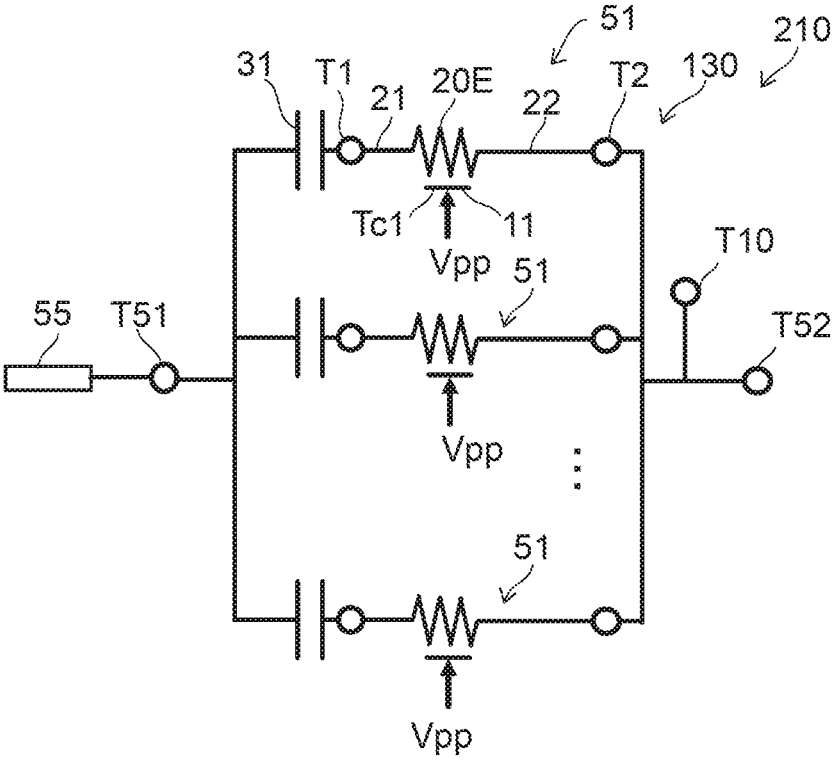
FIG. 18 is a schematic view illustrating a MEMS element according to a third embodiment.

FIG. 18 is a schematic view illustrating a MEMS element according to a third embodiment.

As shown in FIG. 18, the MEMS element 130 according to the embodiment includes multiple element parts 51. For example, the multiple element parts 51 are connected in parallel. Control signals Vpp are applicable independently to the multiple element parts 51.

For example, the first and second conductive members 21 and 22 included in one of the multiple element parts 51 are breakable independently from the first and second conductive members 21 and 22 included in another one of the multiple element parts 51.

Multiple first capacitance elements 31 are provided in the example. One of the multiple first capacitance elements 31 is connected in series to one of the multiple element parts 51. The MEMS element 130 is a capacitance element array including the multiple element parts 51 and the multiple first capacitance elements 31. Several of the multiple element parts 51 can be set to the off-state. The electrical capacitance of the MEMS element 130 can be modified by setting several of the multiple element parts 51 to the off-state.

Fourth Embodiment

A fourth embodiment relates to an electrical circuit. FIG. 18 illustrates the configuration of the electrical circuit 210 according to the embodiment. As shown in FIG. 18, the electrical circuit 210 includes a MEMS element (e.g., the MEMS element 130) according to the first to third embodiments and an electrical element 55. The electrical element 55 is electrically connected to the MEMS element 130. The electrical element 55 includes at least one selected from the group consisting of a resistance, a capacitance element, an inductor element, a diode, and a transistor. The capacitance element included in the electrical element 55 may include a sensor. For example, the electrical element 55 may include a sensor element. For example, the electrical element 55 may include a capacitive sensor element.

In the electrical circuit 210, the MEMS element (e.g., the MEMS element 130) may include multiple element parts 51. The characteristics of the electrical circuit 210 are controllable by breaking the first and second conductive members 21 and 22 included in at least one of the multiple element parts 51.

For example, when the MEMS element 130 includes the first capacitance element 31, the electrical capacitance of the MEMS element 130 can be controlled by breaking the first and second conductive members 21 and 22 included in at least one of the multiple element parts 51. As a result, the characteristics of the electrical circuit 210 are controllable.

For example, the electrical circuit 210 may be used in a voltage-controlled oscillator (VCO). For example, the electrical circuit 210 may be used in an impedance matching circuit of a high frequency circuit such as an antenna, etc. For example, the electrical circuit 210 may be used in a passive RF tag. For example, the characteristics of the electrical circuit 210 can be appropriately adjusted by adjusting an electrical capacitance or an inductor of the electrical circuit 210. For example, a voltage-controlled oscillator (VCO) that has stable characteristics is obtained. For example, stable characteristics are obtained in the impedance matching circuit of a high frequency circuit such as an antenna, etc. For example, a passive RF tag or the like that has stable characteristics is obtained.

Figure 19:
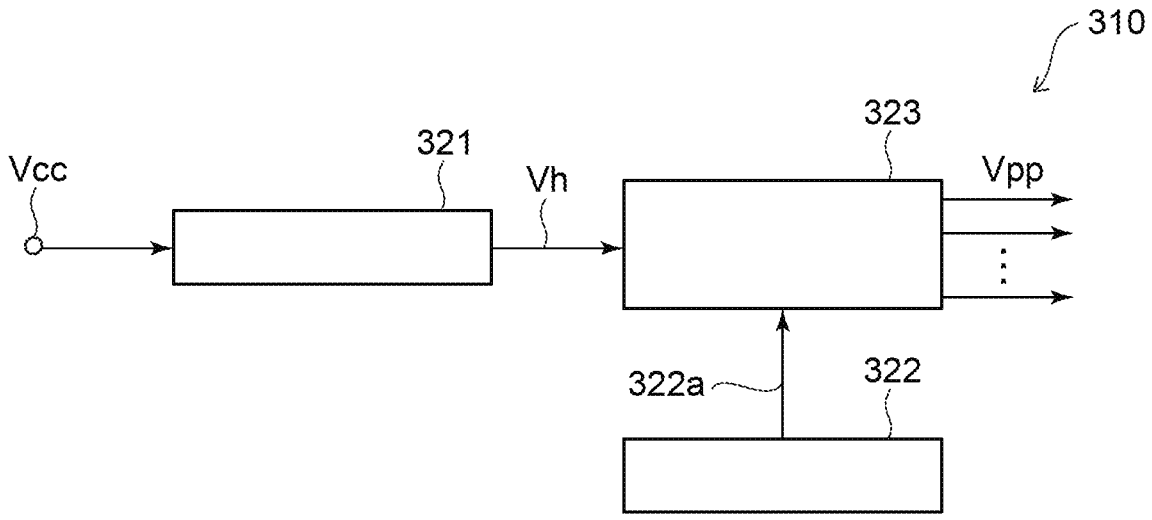
FIG. 19 is a schematic view illustrating a control circuit used in the MEMS element according to the embodiment.
Figure 20:
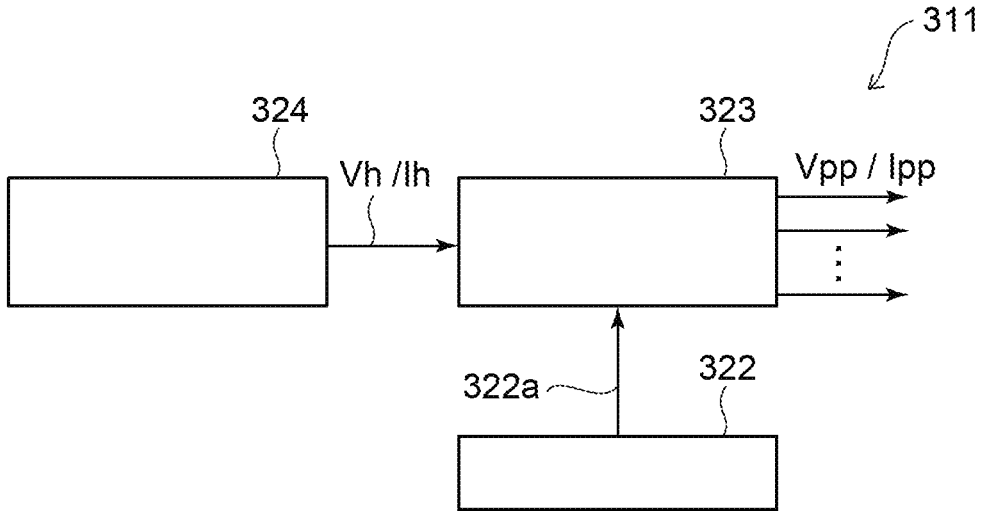
FIG. 20 is a schematic view illustrating a control circuit used in the MEMS element according to the embodiment.

FIG. 19 and FIG. 20 are schematic views illustrating control circuits used in the MEMS element according to the embodiment.

As shown in FIG. 19, a control circuit 310 includes a voltage step-up circuit 321, a logic circuit 322, and a switching matrix 323. A power supply voltage Vcc is supplied to the voltage step-up circuit 321. The voltage step-up circuit 321 outputs a high voltage Vh to the switching matrix 323. The switching matrix 323 outputs multiple control signals Vpp according to a signal 322*a* supplied from the logic circuit 322 to the switching matrix 323. One of the multiple control signals Vpp is supplied to one of the multiple element parts 51.

As shown in FIG. 20, a control circuit 311 includes a control power supply 324, the logic circuit 322, and the switching matrix 323. The control power supply 324 is, for example, a control voltage source or a control current source. The control power supply 324 outputs, to the switching matrix 323, the high voltage Vh and a large current Ih. The switching matrix 323 outputs the multiple control signals Vpp according to the signal 322*a* supplied to the switching matrix 323 from the logic circuit 322. One of the multiple control signals Vpp is supplied to one of the multiple element parts 51. The switching matrix 323 may output multiple control currents Ipp. One of the multiple control currents Ipp is supplied to one of the multiple element parts 51.

For example, at least a portion of the control circuits 310 and 311 is included in, for example, the controller 70.

Examples of the first electrical signal Sg1 supplied between the second conductive member 22 and the first fixed electrode 11 from the controller 70 will now be described.

Figure 21A:
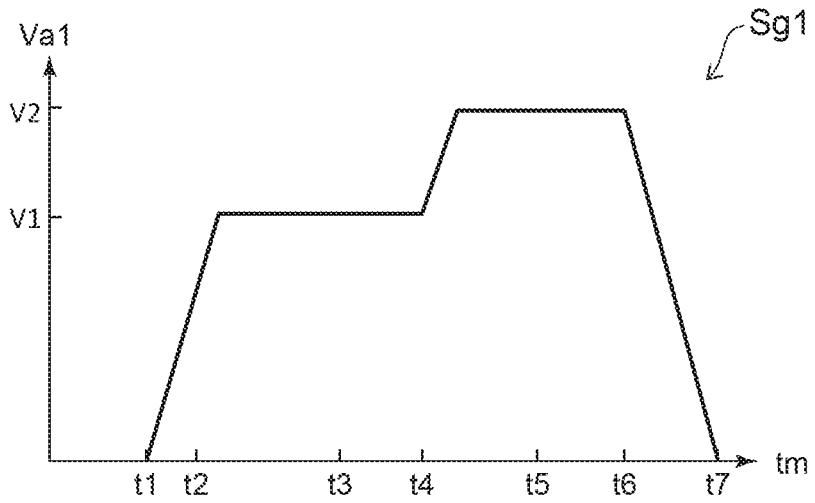
FIG. 21A and FIG. 21B are schematic views illustrating an operation relating to the MEMS element according to the first embodiment.
Figure 21B:
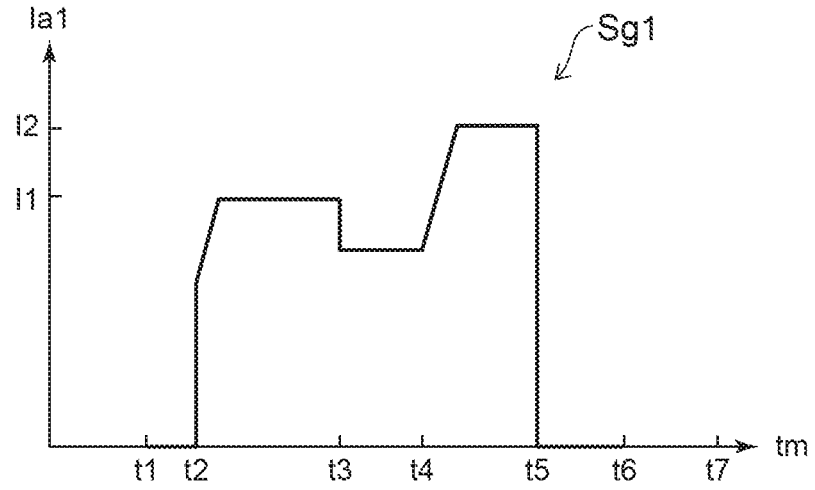

FIG. 21A and FIG. 21B are schematic views illustrating an operation relating to the MEMS element according to the first embodiment.

These figures show one example of the first electrical signal Sg1. In these figures, the horizontal axis is the time tm. The vertical axis of FIG. 21A is a voltage Va1 of the first electrical signal Sg1. The vertical axis of FIG. 21B is a current Ia1 of the first electrical signal Sg1.

As shown in FIG. 21A, the voltage Va1 starts to increase at a first time t1. The voltage Va1 reaches a first voltage V1 after a second time t2. The first voltage V1 is maintained through third and fourth times t3 and t4, and the voltage Va1 starts to increase at the fourth time t4. The voltage Va1 becomes a second voltage V2 after the fourth time t4. Subsequently, the voltage Va1 is maintained at the second voltage V2 from a fifth time t5 to a sixth time t6. The voltage Va1 starts to drop at the sixth time t6. The drop of the voltage Va1 ends at a seventh time t7; for example, the voltage Va1 becomes 0 volts. The absolute value of the first voltage V1 is less than the absolute value of the second voltage V2.

As shown in FIG. 21B, the current Ia1 substantially does not flow between the first time t1 and the second time t2. The current Ia1 becomes a first current I1 after the second time t2. The current Ia1 is less than the first current I1 from the third time t3 to the fourth time t4. The current Ia1 starts to rise at the fourth time t4 and becomes a second current I2. The current Ia1 starts to drop at the fifth time t5, and the current Ia1 does not flow at the sixth time t6. The absolute value of the first current I1 is less than the absolute value of the second current I2.

For example, the first movable electrode 20E approaches the first fixed electrode 11 in the period from the first time t1 to the second time t2. For example, a portion of the first movable electrode 20E (e.g., a portion at the first conductive member 21 side) contacts the first fixed electrode 11 at the second time t2. Thereby, in the period from the second time t2 to the third time t3, the current Ia1 increases, and the current Ia1 becomes the first current I1. For example, the first conductive member 21 breaks at the third time t3, and the current Ia1 decreases. Subsequently, in the period from the fourth time t4 to the fifth time t5, the second conductive member 22 side of the first movable electrode 20E approaches the first fixed electrode 11, and the current Ia1 increases. The current Ia1 becomes the second current I2 when the first movable electrode 20E contacts the first fixed electrode 11. The second conductive member 22 breaks at the fifth time t5, and the current Ia1 drops.

For example, the first conductive member 21 and the second conductive member 22 are broken by the voltage Va1 and the current Ia1 illustrated in FIG. 21A and FIG. 21B.

Figure 22A:
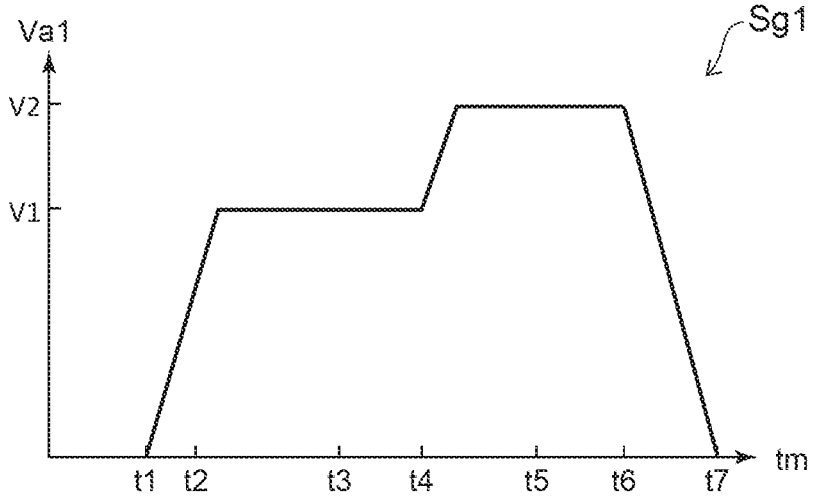
FIG. 22A and FIG. 22B are schematic views illustrating an operation relating to the MEMS element according to the first embodiment.
Figure 22B:
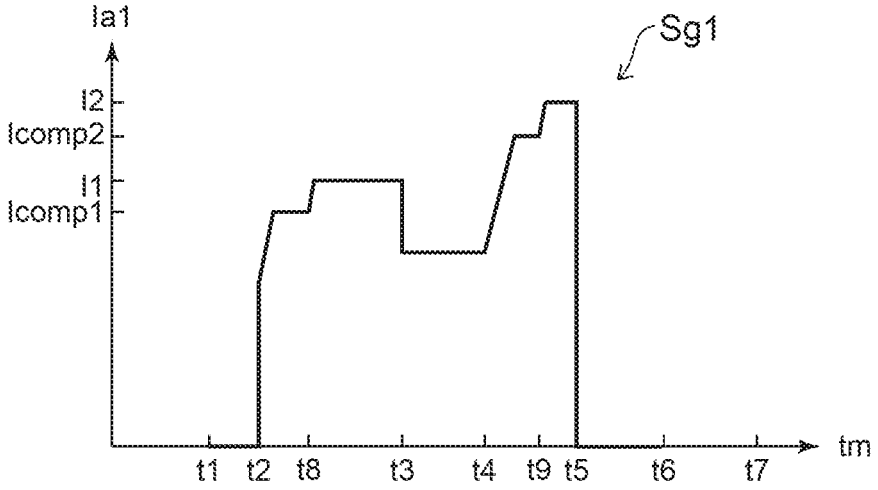

FIG. 22A and FIG. 22B are schematic views illustrating an operation relating to the MEMS element according to the first embodiment.

These figures show another first electrical signal Sg1. In these figures, the horizontal axis is the time tm. The vertical axis of FIG. 22A is the voltage Va1 of the first electrical signal Sg1. The vertical axis of FIG. 22B is the current Ia1 of the first electrical signal Sg1.

In the example shown in FIG. 22A, the voltage Va1 changes similarly to FIG. 21A.

As shown in FIG. 22B, a current substantially does not flow between the first time t1 and the second time t2. The current Ia1 becomes a current Icomp1 after the second time t2 in the period between the second time t2 and an eighth time t8. The eighth time t8 is between the second time t2 and the third time t3. The current Ia1 is the first current I1 after the eighth time t8 in the period between the eighth time t8 and the third time t3. The current Ia1 is less than the first current I1 between the third time t3 and the fourth time t4. The current Ia1 starts to rise at the fourth time t4 and reaches a current Icomp2. Subsequently, the current Ia1 again starts to rise at a ninth time t9 and reaches the second current I2. The ninth time t9 is between the fourth time t4 and the fifth time t5. The current Ia1 starts to drop at the fifth time t5, and the current Ia1 does not flow at the sixth time t6. The absolute value of the first current ii is less than the absolute value of the second current I2.

For example, the first movable electrode 20E approaches the first fixed electrode 11 in the period from the first time t1 to the second time t2. For example, a portion of the first movable electrode 20E (e.g., a portion at the first conductive member 21 side) contacts the first fixed electrode 11 at the second time t2. The current Ia1 increases to the current Icomp1 at the second time t2. At the eighth time t8 at which the current Ia1 has reached the current Icomp1, the current Ia1 that is supplied from the controller 70 is increased, and the current Ia1 is set to the first current I1. For example, the first conductive member 21 breaks at the third time t3, and the current Ia1 drops. Subsequently, the second conductive member 22 side of the first movable electrode 20E starts to approach the first fixed electrode 11 at the fourth time t4, and the current Ia1 increases. The first movable electrode 20E contacts the first fixed electrode 11, and the current Ia1 increases to the current Icomp2. At the ninth time t9 at which the current Ia1 has reached the current Icomp2, the current Ia1 that is supplied by the controller 70 is increased, and the current Ia1 is set to the second current I2. At the fifth time t5, the second conductive member 22 breaks, and the current Ia1 drops.

For example, the first conductive member 21 and the second conductive member 22 are broken by the voltage Va1 and the current Ia1 illustrated in FIG. 22A and FIG. 22B.

The embodiments may include the following configurations (e.g., technological proposals).

Configuration 1

A MEMS element, comprising:

a first member; and an element part, the element part including a first fixed electrode fixed to the first member, a first movable electrode facing the first fixed electrode, a first conductive member electrically connected to the first movable electrode, and a second conductive member electrically connected to the first movable electrode, the first conductive member and the second conductive member supporting the first movable electrode to be separated from the first fixed electrode in a first state before a first electrical signal is applied between the second conductive member and the first fixed electrode, the first conductive member and the second conductive member being in a broken state in a second state after the first electrical signal is applied between the second conductive member and the first fixed electrode.

Configuration 2

The MEMS element according to Configuration 1, wherein a rigidity of the first conductive member is different from a rigidity of the second conductive member.

Configuration 3

The MEMS element according to Configuration 1 or 2, wherein the first conductive member has a first length along a first current path, and a first width in a direction perpendicular to the first current path, the first current path including the first conductive member and the first movable electrode, and the second conductive member has at least one of a second length along a second current path, or a second width in a direction perpendicular to the second current path, the second current path including the second conductive member and the first movable electrode, the second length being less than the first length, the second width being greater than the first width.

Configuration 4

The MEMS element according to any one of Configurations 1 to 3, wherein at least one of a portion of the first conductive member or a portion of the second conductive member overlaps the first fixed electrode in a first direction from the first fixed electrode toward the first movable electrode.

Configuration 5

The MEMS element according to any one of Configurations 1 to 3, wherein the first conductive member includes a first notch portion and a first non-notch portion, a direction from the first notch portion toward the first non-notch portion being along a first current path including the first conductive member and the first movable electrode, and a length of the first notch portion along a first cross direction perpendicular to the first current path is less than a length of the first non-notch portion along the first cross direction.

Configuration 6

The MEMS element according to Configuration 5, wherein a distance between the first notch portion and the first movable electrode is not more than ½ of a first length of the first conductive member along a first current path, the first current path including the first conductive member and the first movable electrode.

Configuration 7

The MEMS element according to Configuration 5 or 6, wherein the first notch portion overlaps an end portion of the first fixed electrode in a first direction from the first fixed electrode toward the first movable electrode.

Configuration 8

The MEMS element according to any one of Configurations 5 to 7, wherein the second conductive member includes a second notch portion and a second non-notch portion, a direction from the second notch portion toward the second non-notch portion being along a second current path including the second conductive member and the first movable electrode, and a length of the second notch portion along a second cross direction perpendicular to the second current path is less than a length of the second non-notch portion along the second cross direction.

Configuration 9

The MEMS element according to any one of Configurations 1 to 3, wherein the second conductive member includes a second notch portion and a second non-notch portion, a direction from the second notch portion toward the second non-notch portion being along a second current path including the second conductive member and the first movable electrode, a length of the second notch portion along a second cross direction perpendicular to the second current path is less than a length of the second non-notch portion along the second cross direction, and the second notch portion overlaps an end portion of the first fixed electrode in a first direction from the first fixed electrode toward the first movable electrode.

Configuration 10

The MEMS element according to any one of Configurations 1 to 9, further comprising:

a second member, the first fixed electrode and the first movable electrode being between the first member and the second member, a first gap being between the first fixed electrode and the first movable electrode in the first state, a second gap being between the first movable electrode and the second member in the first state.

Configuration 11

The MEMS element according to any one of Configurations 1 to 10, wherein a current can flow between the first movable electrode and the first fixed electrode when the first electrical signal is applied between the second conductive member and the first fixed electrode.

Configuration 12

The MEMS element according to any one of Configurations 1 to 11, wherein the first movable electrode contacts the first fixed electrode when the first electrical signal is applied between the second conductive member and the first fixed electrode.

Configuration 13

The MEMS element according to any one of Configurations 1 to 12, wherein the element part further includes a first capacitance element electrically connected to the first conductive member.

Configuration 14

The MEMS element according to any one of Configurations 1 to 13, wherein the element part further includes a second fixed electrode fixed to the first member, the first movable electrode includes a first electrode region and a second electrode region, a distance between the first electrode region and the first conductive member is less than a distance between the second electrode region and the first conductive member, the first electrode region faces the first fixed electrode, the second electrode region faces the second fixed electrode, the first state is before a second electrical signal is applied between the second conductive member and the second fixed electrode, the first conductive member and the second conductive member support the first movable electrode to be separated from the second fixed electrode in the first state, the second state is after the second electrical signal is applied between the second conductive member and the second fixed electrode, and the first conductive member and the second conductive member are in a broken state in the second state.

Configuration 15

The MEMS element according to Configuration 14, wherein a start of an application of the second electrical signal is after a start of an application of the first electrical signal.

Configuration 16

The MEMS element according to Configuration 15, wherein an end of the application of the second electrical signal is after an end of the application of the first electrical signal.

Configuration 17

The MEMS element according to any one of Configurations 14 to 16, wherein the first movable electrode further includes a third electrode region between the first electrode region and the second electrode region, the element part includes a first supporter fixed to the first member, a second supporter fixed to the first member, and a third supporter fixed to the first member, the first supporter supports at least a portion of the first conductive member to be separated from the first member, the second supporter supports at least a portion of the second conductive member to be separated from the first member, and the third supporter supports at least a portion of the third electrode region to be separated from the first member.

Configuration 18

The MEMS element according to any one of Configurations 1 to 13, wherein the first movable electrode includes a first electrode region, a second electrode region, and a third electrode region, the first electrode region being between the first conductive member and the second conductive member, the second electrode region being between the first electrode region and the second conductive member, the third electrode region being between the first electrode region and the second electrode region, the element part includes a first supporter fixed to the first member, a second supporter fixed to the first member, and a third supporter fixed to the first member, the first supporter supports at least a portion of the first conductive member to be separated from the first member, the second supporter supports at least a portion of the second conductive member to be separated from the first member, and the third supporter supports at least a portion of the third electrode region to be separated from the first member.

Configuration 19

The MEMS element according to Configuration 17 or 18, wherein the first movable electrode includes a first extension region, the first extension region extends along an extension direction, the extension direction is along a surface of the first member and crosses a direction from the first electrode region toward the second electrode region, a portion of the first extension region is connected to the third electrode region, and an other portion of the first extension region is connected to the third supporter.

Configuration 20

The MEMS element according to Configuration 19, wherein the first movable electrode includes a second extension region, the third electrode region is between the first extension region and the second extension region in the extension direction, the element part further includes a fourth supporter fixed to the first member, a portion of the second extension region is connected to the third electrode region, and an other portion of the second extension region is connected to the fourth supporter.

Configuration 21

The MEMS element according to any one of Configurations 1 to 20, wherein at least one of the first conductive member or the second conductive member includes at least one selected from the group consisting of Al, Cu, Au, Ti, Pd, Pt, and W.

Configuration 22

The MEMS element according to any one of Configurations 1 to 21, comprising:

a plurality of the element parts, the first and second conductive members included in one of the plurality of element parts being breakable independently from the first and second conductive members included in an other one of the plurality of element parts.

Configuration 23

An electrical circuit, comprising:

the MEMS element according to any one of Configurations 1 to 22; and an electrical element electrically connected to the MEMS element, the electrical element including at least one selected from the group consisting of a resistance, a capacitance element, an inductor element, a diode, and a transistor.

Configuration 24

An electrical circuit, comprising:

the MEMS element according to any one of Configurations 1 to 22; and an electrical element electrically connected to the MEMS element, the electrical element including a sensor element.

Configuration 25

The electrical circuit according to Configuration 23 or 24, wherein the MEMS element includes a plurality of the element parts, and a characteristic of the electrical circuit is controllable by breaking the first and second conductive members included in at least one of the plurality of element parts.

According to the embodiments, a MEMS element and an electrical circuit can be provided in which a stable operation is possible.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in MEMS elements and electrical circuits such as first members, element parts, fixed electrodes, movable electrodes, first conductive members, second conductive members, etc., from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all MEMS elements, and electrical circuits practicable by an appropriate design modification by one skilled in the art based on the MEMS members, and the electrical circuits described above as embodiments of the invention also are within the scope of the invention to the extent that the purport of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A MEMS element, comprising:

a first member; and an element part, the element part including a first fixed electrode fixed to the first member, a first movable electrode facing the first fixed electrode, a first conductive member electrically connected to the first movable electrode, and a second conductive member electrically connected to the first movable electrode, the first conductive member and the second conductive member supporting the first movable electrode to be separated from the first fixed electrode in a first state before a first electrical signal is applied between the second conductive member and the first fixed electrode, the first conductive member and the second conductive member being in a broken state in a second state after the first electrical signal is applied between the second conductive member and the first fixed electrode.

2. The element according to claim 1, wherein a rigidity of the first conductive member is different from a rigidity of the second conductive member.

3. The element according to claim 1, wherein the first conductive member has a first length along a first current path, and a first width in a direction perpendicular to the first current path, the first current path including the first conductive member and the first movable electrode, and the second conductive member has at least one of a second length along a second current path, or a second width in a direction perpendicular to the second current path, the second current path including the second conductive member and the first movable electrode, the second length being less than the first length, the second width being greater than the first width.

4. The element according to claim 1, wherein at least one of a portion of the first conductive member or a portion of the second conductive member overlaps the first fixed electrode in a first direction from the first fixed electrode toward the first movable electrode.

5. The element according to claim 1, wherein the second conductive member includes a second notch portion and a second non-notch portion, a direction from the second notch portion toward the second non-notch portion being along a second current path including the second conductive member and the first movable electrode, a length of the second notch portion along a second cross direction perpendicular to the second current path is less than a length of the second non-notch portion along the second cross direction, and the second notch portion overlaps an end portion of the first fixed electrode in a first direction from the first fixed electrode toward the first movable electrode.

6. The element according to claim 1, further comprising:

a second member, the first fixed electrode and the first movable electrode being between the first member and the second member, a first gap being between the first fixed electrode and the first movable electrode in the first state, a second gap being between the first movable electrode and the second member in the first state.

7. The element according to claim 1, wherein a current can flow between the first movable electrode and the first fixed electrode when the first electrical signal is applied between the second conductive member and the first fixed electrode.

8. The element according to claim 1, wherein the first movable electrode contacts the first fixed electrode when the first electrical signal is applied between the second conductive member and the first fixed electrode.

9. The element according to claim 1, wherein the element part further includes a first capacitance element electrically connected to the first conductive member.

10. The element according to claim 1, wherein the first movable electrode includes a first electrode region, a second electrode region, and a third electrode region, the first electrode region being between the first conductive member and the second conductive member, the second electrode region being between the first electrode region and the second conductive member, the third electrode region being between the first electrode region and the second electrode region, the element part includes a first supporter fixed to the first member, a second supporter fixed to the first member, and a third supporter fixed to the first member, the first supporter supports at least a portion of the first conductive member to be separated from the first member, the second supporter supports at least a portion of the second conductive member to be separated from the first member, and the third supporter supports at least a portion of the third electrode region to be separated from the first member.

11. An electrical circuit, comprising:

the MEMS element according to claim 1; and an electrical element electrically connected to the MEMS element, the electrical element including at least one selected from the group consisting of a resistance, a capacitance element, an inductor element, a diode, and a transistor.

12. The element according to claim 1, wherein the first conductive member includes a first notch portion and a first non-notch portion, a direction from the first notch portion toward the first non-notch portion being along a first current path including the first conductive member and the first movable electrode, and a length of the first notch portion along a first cross direction perpendicular to the first current path is less than a length of the first non-notch portion along the first cross direction.

13. The element according to claim 12, wherein a distance between the first notch portion and the first movable electrode is not more than ½ of a first length of the first conductive member along a first current path, the first current path including the first conductive member and the first movable electrode.

14. The element according to claim 12, wherein the first notch portion overlaps an end portion of the first fixed electrode in a first direction from the first fixed electrode toward the first movable electrode.

15. The element according to claim 12, wherein the second conductive member includes a second notch portion and a second non-notch portion, a direction from the second notch portion toward the second non-notch portion being along a second current path including the second conductive member and the first movable electrode, and a length of the second notch portion along a second cross direction perpendicular to the second current path is less than a length of the second non-notch portion along the second cross direction.

16. The element according to claim 1, wherein the element part further includes a second fixed electrode fixed to the first member, the first movable electrode includes a first electrode region and a second electrode region, a distance between the first electrode region and the first conductive member is less than a distance between the second electrode region and the first conductive member, the first electrode region faces the first fixed electrode, the second electrode region faces the second fixed electrode, the first state is before a second electrical signal is applied between the second conductive member and the second fixed electrode, the first conductive member and the second conductive member support the first movable electrode to be separated from the second fixed electrode in the first state, the second state is after the second electrical signal is applied between the second conductive member and the second fixed electrode, and the first conductive member and the second conductive member are in the broken state in the second state.

17. The element according to claim 16, wherein a start of an application of the second electrical signal is after a start of an application of the first electrical signal.

18. The MEMS element according to claim 17, wherein an end of the application of the second electrical signal is after an end of the application of the first electrical signal.

19. The element according to claim 16, wherein the first movable electrode further includes a third electrode region between the first electrode region and the second electrode region, the element part includes a first supporter fixed to the first member, a second supporter fixed to the first member, and a third supporter fixed to the first member, the first supporter supports at least a portion of the first conductive member to be separated from the first member, the second supporter supports at least a portion of the second conductive member to be separated from the first member, and the third supporter supports at least a portion of the third electrode region to be separated from the first member.

20. The element according to claim 19, wherein the first movable electrode includes a first extension region, the first extension region extends along an extension direction, the extension direction is along a surface of the first member and crosses a direction from the first electrode region toward the second electrode region, a portion of the first extension region is connected to the third electrode region, and an other portion of the first extension region is connected to the third supporter.

* * * * *